US010743679B2

(12) United States Patent
McKeever et al.

(10) Patent No.: US 10,743,679 B2
(45) Date of Patent: Aug. 18, 2020

(54) UNIVERSAL CUP DISPENSER

(71) Applicant: PETER J. MCKEEVER, INC., Santa Fe Springs, CA (US)

(72) Inventors: Peter J. McKeever, Santa Fe Springs, CA (US); Mark A. McKeever, Santa Monica, CA (US)

(73) Assignee: PETER J. MCKEEVER, INC., Santa Fe Springs, CA (US)

( * ) Notice: Subject to any disclaimer, the term of this patent is extended or adjusted under 35 U.S.C. 154(b) by 0 days.

(21) Appl. No.: 16/581,581

(22) Filed: Sep. 24, 2019

(65) Prior Publication Data

US 2020/0107651 A1 Apr. 9, 2020

Related U.S. Application Data

(60) Provisional application No. 62/743,318, filed on Oct. 9, 2018.

(51) Int. Cl.
*A47F 1/06* (2006.01)

(52) U.S. Cl.
CPC ..... *A47F 1/065* (2013.01)

(58) Field of Classification Search
USPC ..... 221/223, 307, 312 R; 24/455; D15/145; D8/358
See application file for complete search history.

(56) References Cited

U.S. PATENT DOCUMENTS 1,975,649 A 10/1934 Reifsnyder
2,730,268 A 1/1956 Moesch
4,854,479 A 8/1989 Callahan et al.
5,012,952 A * 5/1991 Franz ..... G07F 13/10 221/221
6,398,072 B1 6/2002 Nitta et al.
2007/0295746 A1* 12/2007 Gapp ..... G07F 11/04 221/304
2008/0284291 A1* 11/2008 Stamatis Filho ..... A47F 1/085 312/43
2009/0057334 A1* 3/2009 Pearl ..... A47F 1/085 221/307
2011/0226799 A1 9/2011 Watson et al.
2011/0248041 A1* 10/2011 Dooley ..... A47F 1/065 221/1
2011/0284572 A1* 11/2011 Meyer ..... A47F 1/065 221/251

(Continued)

FOREIGN PATENT DOCUMENTS

GB 2323356 A 9/1998

*Primary Examiner* — Gene O Crawford
*Assistant Examiner* — Ayodeji T Ojofeitimi
(74) *Attorney, Agent, or Firm* — Knobbe, Martens, Olson & Bear, LLP

(57) ABSTRACT

Disclosed are embodiments of cup dispensers that can accommodate a variety of different cup sizes, cup shapes, and/or cup materials without the need for manual adjustment. In some embodiments, the cup dispenser can automatically adjust the applied pressure via fingers/blocks on one or more contact points on a cup among an inserted sleeve of cups. In some embodiments, sets of blocks can be placed at varying depths. In some embodiments, one set of blocks can hold the cup currently being dispensed while another set of blocks can hold the next cup in the sleeve in place, for example.

20 Claims, 28 Drawing Sheets

(56) References Cited

U.S. PATENT DOCUMENTS

| | | | | |
|---|---|---|---|---|
| 2014/0263395 | A1* | 9/2014 | Gunderson | G07F 11/38 221/221 |
| 2015/0320236 | A1* | 11/2015 | Paradise | A47F 1/065 221/221 |

* cited by examiner

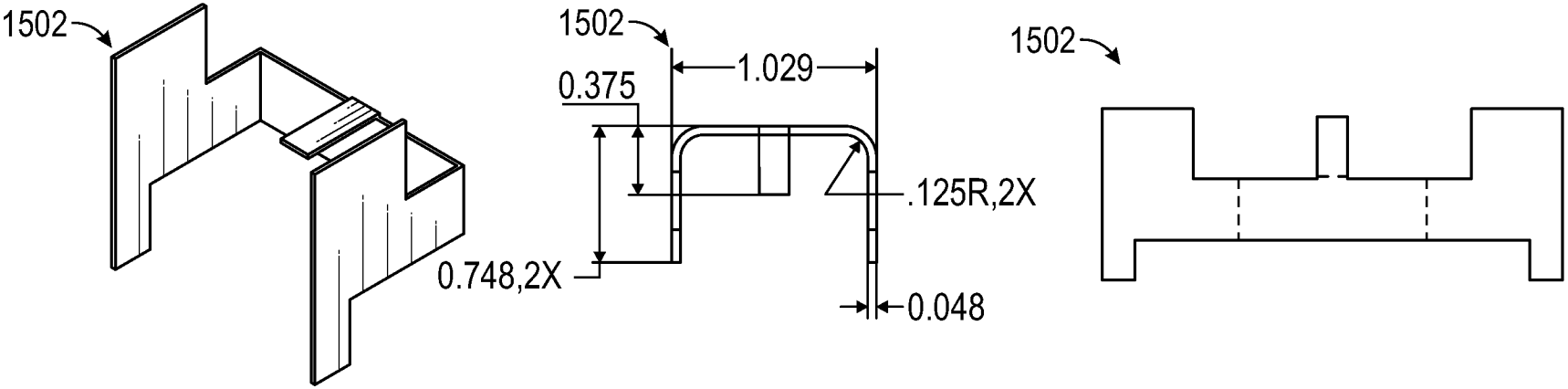
FIG. 15A
FIG. 15B
FIG. 15C
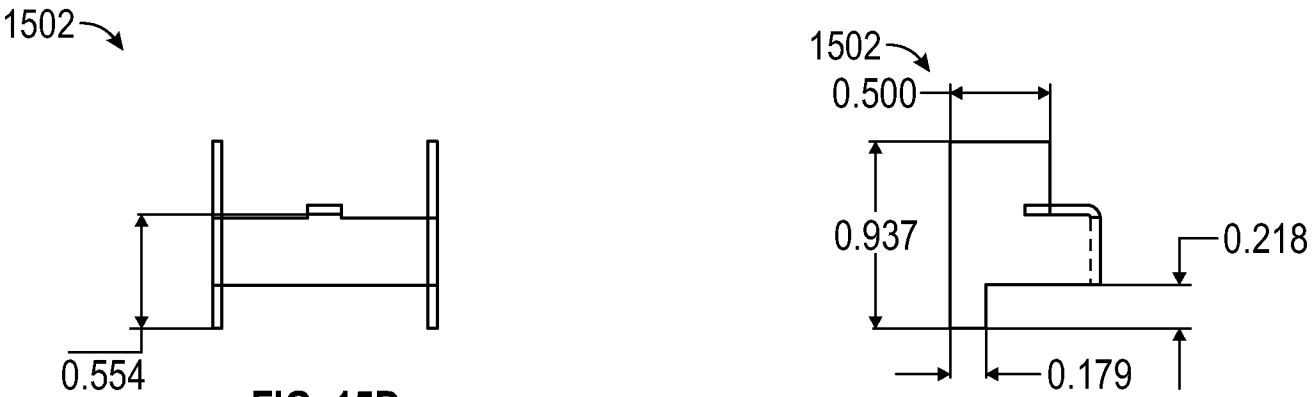
FIG. 15D
FIG. 15E

UNIVERSAL CUP DISPENSER

CROSS REFERENCE

This application claims the benefit of U.S. Provisional Patent Application No. 62/743,318, filed Oct. 9, 2018, the entirety of which is hereby incorporated by reference.

FIELD

The current subject matter is directed to cup dispensers, in particular cup dispensers for various shapes, sizes, and/or materials.

DESCRIPTION OF RELATED ART

Cup dispensers are often used to dispense cups for customers, such as in restaurants and convenience stores. Cups can be stacked on top of one another and can be placed into a cup dispenser for the cup dispenser to be able to dispense multiple cups sequentially.

SUMMARY

The innovations described in the claims each have several aspects, no single one of which is solely responsible for the desirable attributes. Without limiting the scope of the claims, some prominent features of this disclosure will now be briefly described.

Some embodiments include a cup dispensing system comprising: an elongate tube configured to retain a stack of cups; an elongate plunger arm configured to resiliently extend fully or partially along a length of the tube and having a plunger end configured to interface with an end of the stack of cups such that the plunger arm pushes at least one of the stack of cups to protrude from the elongate tube to facilitate dispensing; a circumferential mounting plate having a plurality of sliding tracks therein and configured to extend around a protruding cup in the stack of cups; and a plurality of fingers configured to resiliently extend inwardly from the circumferential mounting plate, each of the plurality of fingers configured to slide along one of the sliding tracks therein to extend inwardly; each of the plurality of fingers configured with a blunted point forming one or more contact surfaces that are configured to interact with various types of cups to allow them to be dispensed one at a time, retaining the remaining cups in a stack of cups as the plunger is advanced farther along the tube in the direction of the circumferential mounting plate.

In some embodiments of the cup dispending system above or otherwise disclosed herein, the cup dispending system can further comprise a circumferential carrier plate that, together with the circumferential mounting plate, house the sliding tracks for the plurality of fingers.

In some embodiments of the cup dispending system above or otherwise disclosed herein, each finger can comprise a plurality of angled faces, wherein a first angled face of the plurality of angled faces is configured to accommodate cup loading, and a second angled face of the plurality of angled faces is configured to accommodate cup dispensing.

In some embodiments of the cup dispending system above or otherwise disclosed herein, each angled face can interact mechanically with a spring located behind the finger to facilitate loading and dispensing.

In some embodiments of the cup dispending system above or otherwise disclosed herein, the plurality of fingers can comprise at least a first and second type of fingers, the first type having a different shape and angles than the second type, wherein the first type interacts differently with the stack of cups than the second type.

In some embodiments of the cup dispending system above or otherwise disclosed herein, each of the fingers can comprise a spring that extends radially from an elongate axis of the tube, exerts a force against the finger toward a central axis of the tube when compressed outwardly.

In some embodiments of the cup dispending system above or otherwise disclosed herein, the spring can be held in place with at least one protruding tab that is rigidly associated with the circumferential mounting plate.

In some embodiments of the cup dispending system above or otherwise disclosed herein, the plurality of fingers can include a first and second type, wherein the first type is configured to allow dispending of a leading cup of the stack of cups, wherein the second type is configured to apply pressure to one or more trailing cup of the stack of cups while the first cup is being dispensed, wherein the pressure to the one or more trailing cups are configured to retain the one or more trailing cups while the leading cup is being dispensed.

In some embodiments of the cup dispending system above or otherwise disclosed herein, the plurality of fingers can include a first and second type, wherein the plurality of fingers corresponding to the first type is disposed at a first depth from the facing entry for the cups, and the plurality of fingers corresponding to the second type is disposed at a second depth from the facing entry for the cups.

In some embodiments of the cup dispending system above or otherwise disclosed herein, the plurality of fingers can include a first and second type, wherein the plurality of fingers corresponding to the first type and the plurality of fingers corresponding to the second type are staggered such that the point of contact to the cup for the plurality of fingers corresponding to the first type is different than the point of contact to the cup for the plurality of fingers corresponding to the first type.

In some embodiments of the cup dispending system above or otherwise disclosed herein, the plurality of fingers can include a first and second type, wherein the plurality of fingers corresponding to the first type is configured for a first type of cup, and the plurality of fingers corresponding to the second type is configured for a second type of cup.

In some embodiments of the cup dispending system above or otherwise disclosed herein, the plurality of fingers include a first and second type, wherein the plurality of fingers corresponding to the first type can comprise a longer taper, and the plurality of fingers corresponding to the second type comprises a shorter taper.

Some embodiments disclose a cup dispenser configured to automatically accommodate for varying cup characteristics, the cup dispenser comprising: a front cover configured to receive a sleeve of cups inserted into the cup dispenser; a mounting plate, wherein the front cover is attached to the mounting plate; a plurality of blocks, each block configured to apply pressure to a contact point on at least a cup of the sleeve of cups; a first spring configured to resiliently apply a first pressure applied by a first subset of the plurality of blocks to a first contact point of a first contact point type on the cup; a cup retainer tube configured to contain the sleeve of cups; a rear tube cap configured to stop the sleeve of cups that is inserted into the cup dispenser; a cup plunger; and a second spring configured to apply pressure to the cup plunger in order to push the cups to the front cover for dispensing of the cups.

In some embodiments of the cup dispenser above or otherwise disclosed herein, the first spring can be non-parallel with the second spring.

In some embodiments of the cup dispenser above or otherwise disclosed herein, the first spring can be orthogonal with the second spring.

In some embodiments of the cup dispenser above or otherwise disclosed herein, the pressure exerted by the first spring can be orthogonal to the pressure exerted by the second spring.

In some embodiments of the cup dispenser above or otherwise disclosed herein, the cup dispensing system further can comprises a third spring configured to apply a second pressure applied by a second subset of the plurality of blocks to a second contact point of a second contact point type on the cup.

In some embodiments of the cup dispenser above or otherwise disclosed herein, the first pressure and second pressure are different.

In some embodiments of the cup dispenser above or otherwise disclosed herein, the first spring has a different thickness than the second spring.

In some embodiments of the cup dispenser above or otherwise disclosed herein, the first spring has a different length of the second spring.

For the purposes of summarizing the disclosure, certain aspects, advantages and novel features of the innovations have been described herein. It is to be understood that not necessarily all such advantages may be achieved in accordance with any particular embodiment. Thus, the innovations may be embodied or carried out in a manner that achieves or optimizes one advantage or group of advantages as taught herein without necessarily achieving other advantages as may be taught or suggested herein.

BRIEF DESCRIPTION OF THE DRAWINGS

Embodiments of this disclosure will now be described, by way of non-limiting example, with reference to the accompanying drawings.

FIGS. 15A-15E illustrate a spring retainer bracket according to some embodiments of the present disclosure.

DETAILED DESCRIPTION

Figure 1A:
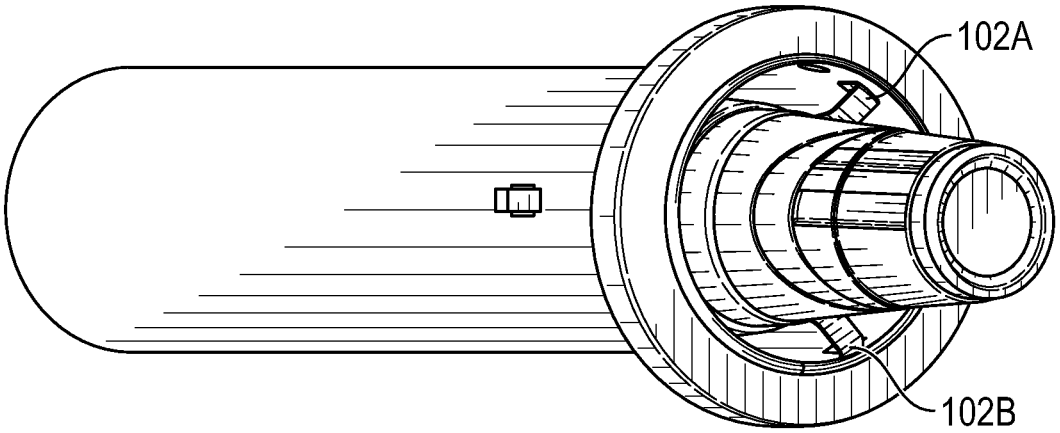
FIGS. 1A and 1B illustrate a cup dispenser with metal and/or plastic plates.

The following detailed description presents various descriptions of features in the context of invention "embodiments." The innovations described herein can be described or embodied in a multitude of ways, for example, as defined and covered by the claims. In this description, reference is made to the drawings where like reference numerals can indicate identical or functionally similar elements. Elements illustrated in the figures are not necessarily drawn to scale. Certain embodiments can include more elements than illustrated in a drawing and/or a subset of the elements illustrated in a drawing. Further, some embodiments can incorporate combinations of features from two or more drawings. The headings provided herein are for convenience only and do not necessarily affect the scope or meaning of the claims.

Cup dispensers using a single tall stack of disposable cups can allow for rapid setup by a single employee and can help to save space. However, certain cup dispensers require adjustment in order to allow cup dispensers to be configured for different shapes, sizes, and/or materials. A problem with the adjustment-requiring cup dispensers is the need for additional replacement parts for broken adjustment features, especially with frequent adjustment by employees. Furthermore, employees often do not set the adjustment properly leading to cups coming out too easily and/or cups becoming hard to pull out. In many circumstances, multiple cups are pulled at a time. Moreover, the adjustment feature may require special tooling and/or physical strength to make such adjustments, which may not be readily available throughout the lifetime of the cup dispenser. Accordingly, there is a need to create a cup dispenser that can accommodate for a variety of shapes, sizes, and/or materials and reduce the need for adjustment.

Figure 1B:
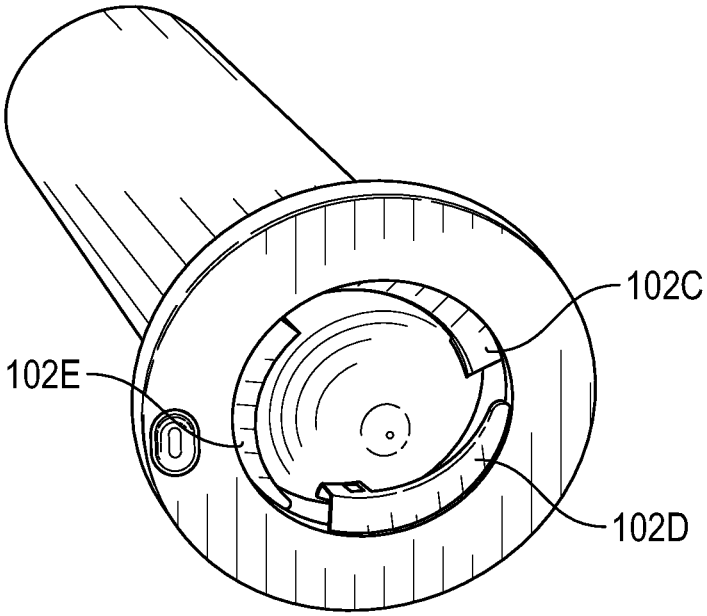

FIGS. 1A and 1B illustrate cup dispensers with metal and/or plastic plates protruding inward from the inner walls of the tubular dispenser body. The cup dispensers of FIGS. 1A and 1B include three metal and/or plastic pieces 102A, 102B, 102C, 102D, 102E that touch the cups to hold the cups in place. However, the three metal and/or plastic pieces 102A, 102B, 102C, 102D, 102E may need to be manually adjusted to accommodate various sizes, shapes, and/or materials, since the pressure the three metal and/or plastic pieces 102A, 102B, 102C, 102D, 102E exert directly on the stack of cups determines the resistance to pulling out the dispensed cup and retaining the remaining cups. Moreover, over time, even for the same size, the metal and/or plastic pieces 102A, 102B, 102C, 102D, 102E may need to be continually adjusted because their resilience, shape, and properties of sliding and static friction (related to their contact surfaces and the materials of the cups) may change over time.

Figure 2:
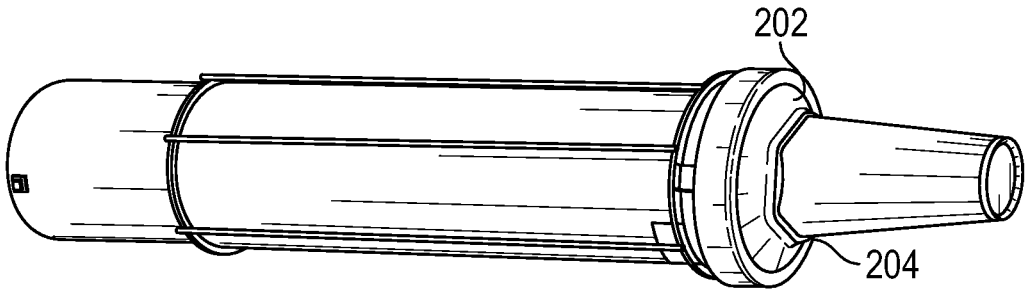
FIG. 2 illustrates a cup dispenser with gaskets.

FIG. 2 illustrates a cup dispenser with a gasket 202 that generally surrounds the cup, allowing the next cup to be dispensed to protrude outward. Such gaskets 202 may provide an inner lip 204 that interacts with an upper lip of a cup. The type of cup dispenser of FIG. 2 can include various gasket sizes configured to accommodate specific sizes, shapes, and/or materials. For example, one gasket can be configured for one sized cup while another gasket is sized for another sized cup. To make such adjustments, the front cover is removed, the correct size gasket is installed, and the front cover is then reinstalled. Thus, the various gaskets often need to be customized for the cup size desired. If multiple gaskets are received for varying cup characteristics, the purchaser may need to store the non-used gaskets for possible future use on different cup sizes.

Figure 3:
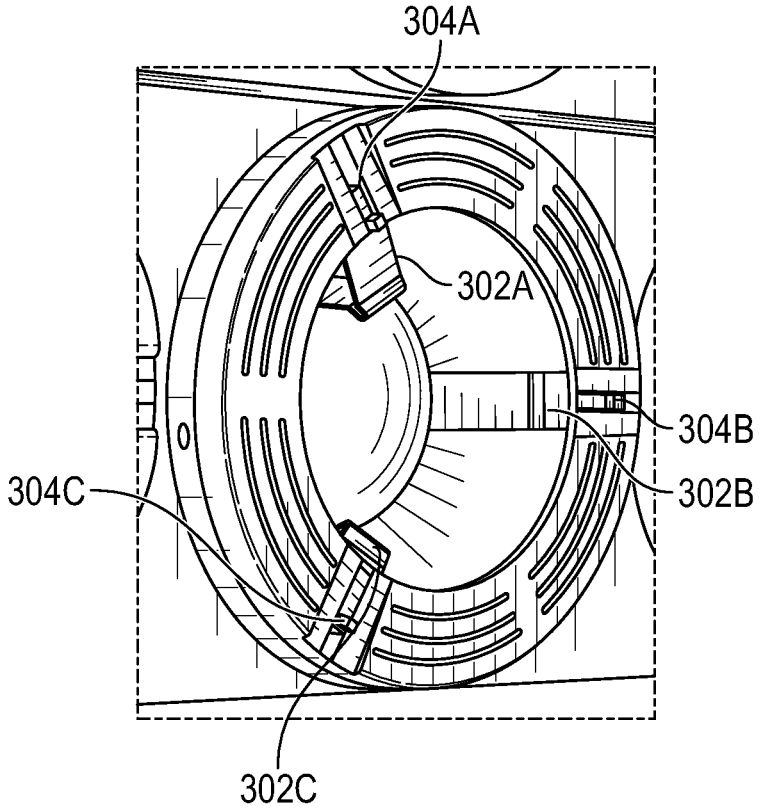
FIG. 3 illustrates a cup dispenser with protrusions permitting manual adjustment.

FIG. 3 illustrates a cup dispenser having three protrusions 302A, 302B, 302C that permit independent manual adjustment by sliding separate tabs 304A, 304B, 304C inward toward the axis of the tubular dispenser. The example shown here has one such protrusion adjusted fully inward 302A, with the other such protrusions adjusted fully outward 302B, 302C. This asymmetry will typically skew the cups so they are not dispensed in line with the tubular axis. This is a common problem because users either do not realize that three independent adjustments are required or simply do not make such adjustments carefully or correctly.

Some embodiments of the present disclosure mitigate and/or eliminate the deficiencies of the examples discussed above. The cup dispenser of some embodiments of the present disclosure has an automatic self-adjusting mechanism to accommodate for varying size cups (such as large or small), varying cup shapes (such as cone or flat bottom), and/or varying cup materials (such as paper, plastic, or Styrofoam). Accordingly, the cup dispenser can be fully operational upon receipt by the purchaser (and upon delivery from the manufacturer and/or retailer) without the need to adjust for cup characteristics. The cup dispenser can simply be installed by placing it on a counter top and/or fastened via screws. Then, users can simply insert a stack or sleeve of cups into the cup dispenser, regardless of the size, shape, and/or material, and customers can immediately obtain a cup from the dispenser by pulling a cup out. In some embodiments, an individual can grab the exterior body of the cup and pull the cup out. The next cup in the sleeve is then positioned for the next individual to withdraw.

Figure 4A:
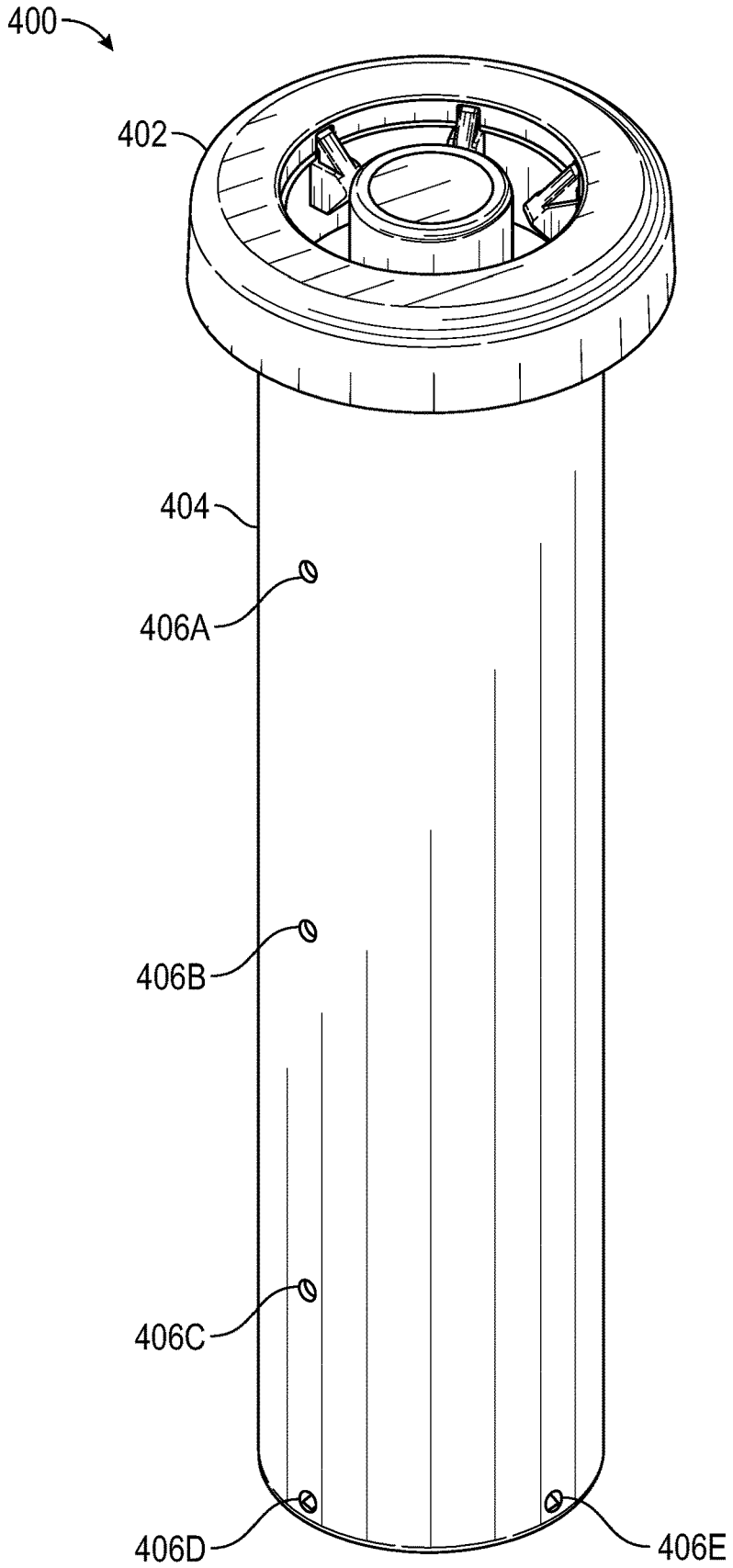
FIG. 4A illustrates a perspective view of a cup dispenser according to some embodiments of the present disclosure. This view shows the dispensing end of the dispenser oriented upward. When installed, the cup dispenser is usually oriented with the cups dispensed either directly outward or downward and outward for the convenience of a user.
Figure 4B:
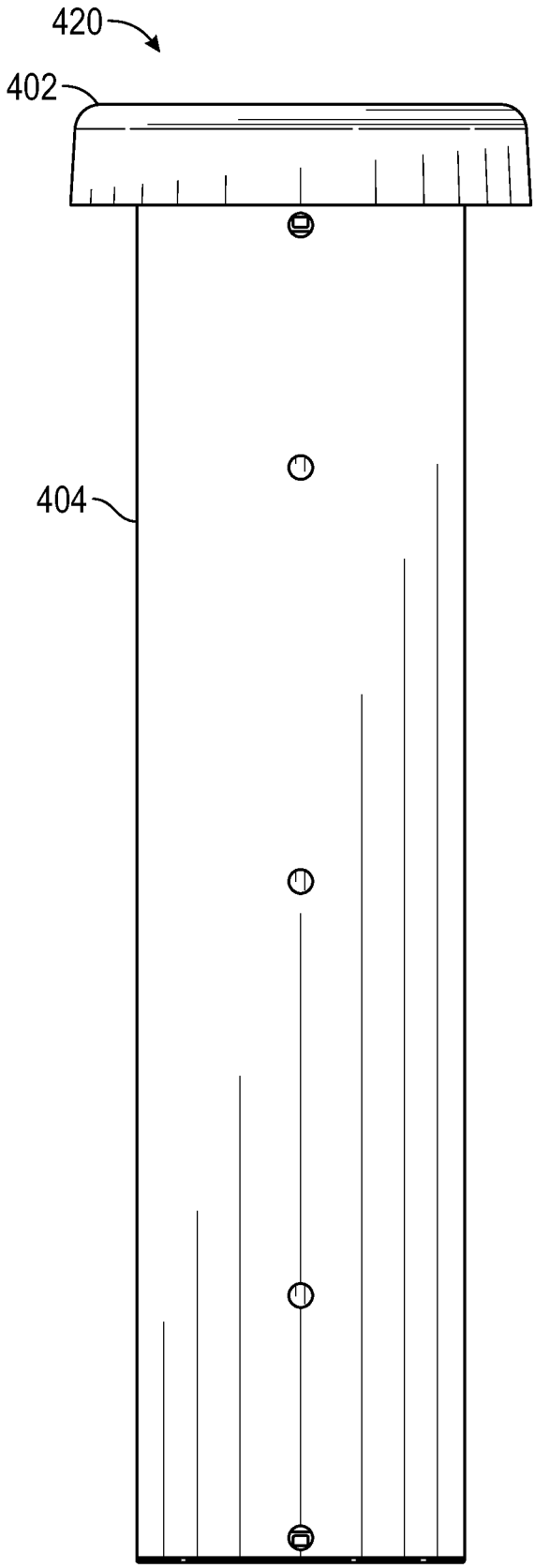
FIG. 4B illustrates a front view of the cup dispenser of FIG. 4A according to some embodiments of the present disclosure.
Figure 4C:
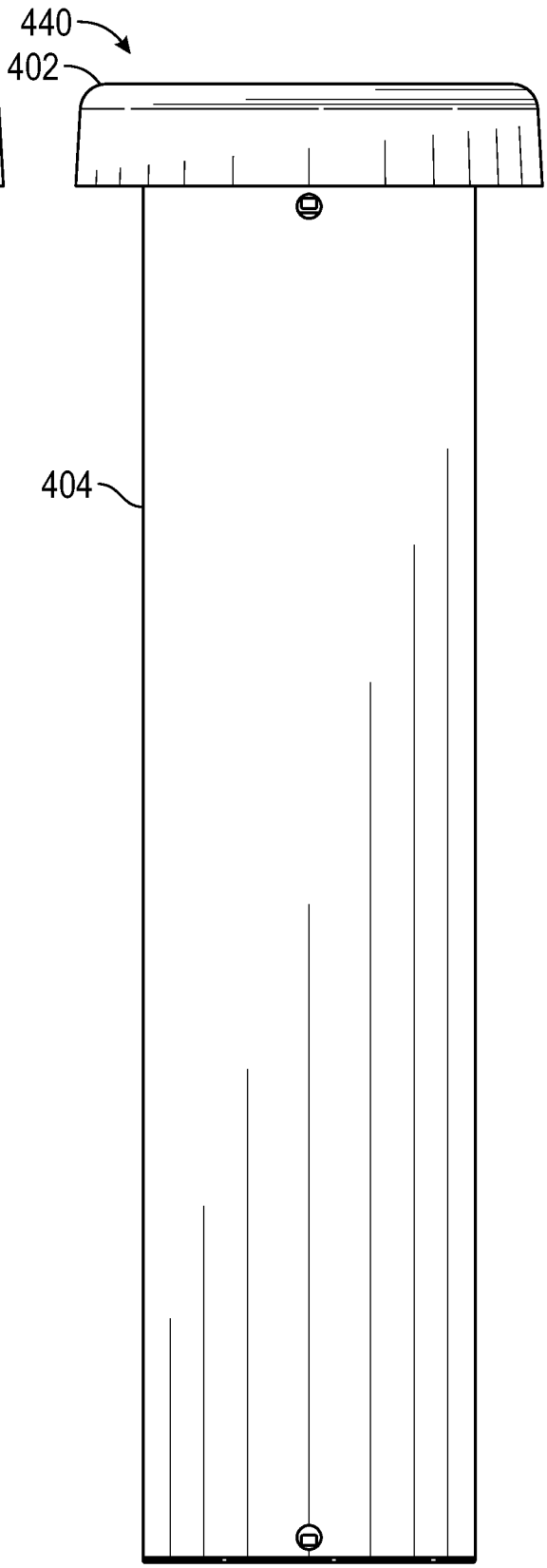
FIG. 4C illustrates a left view of the cup dispenser of FIG. 4A according to some embodiments of the present disclosure.
Figure 4D:
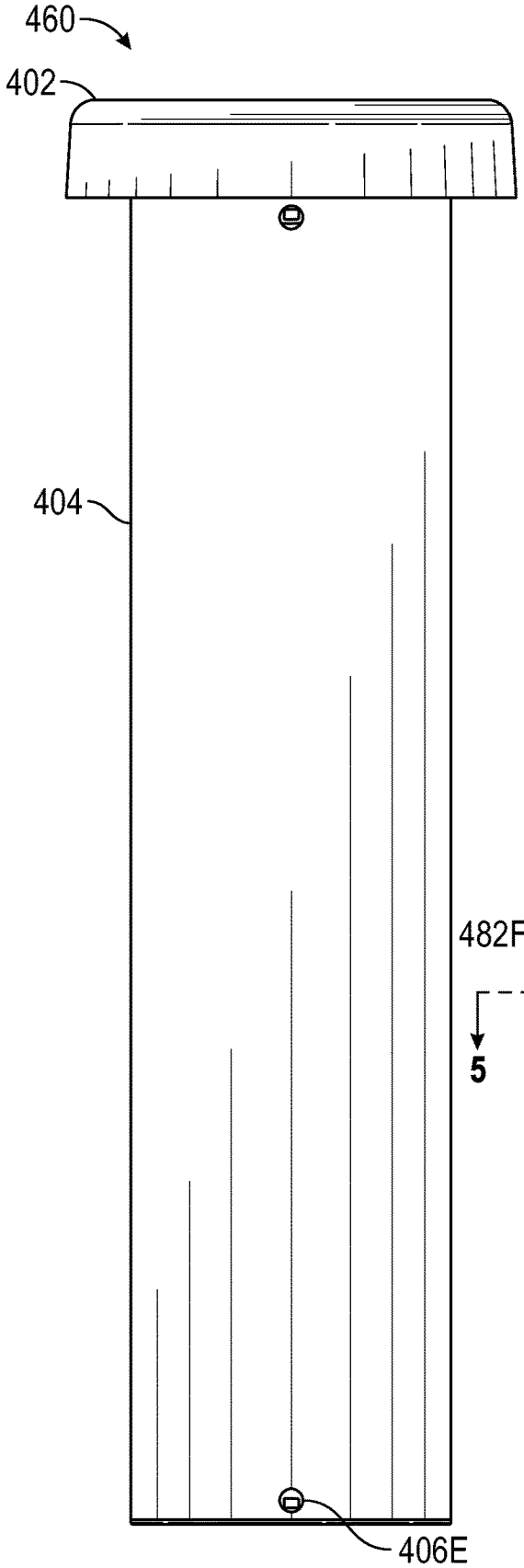
FIG. 4D illustrates a right view of the cup dispenser of FIG. 4A according to some embodiments of the present disclosure.
Figure 4E:
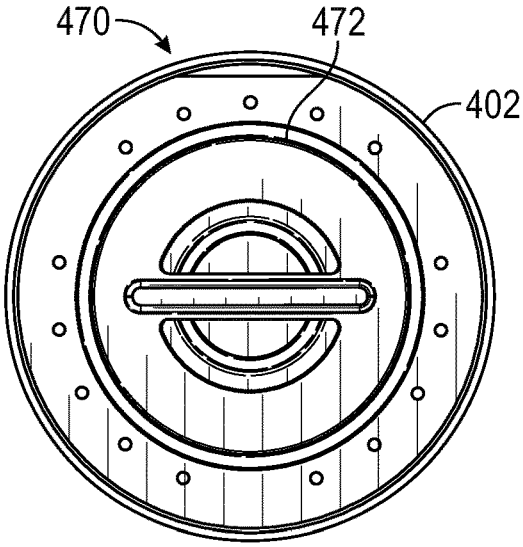
FIG. 4E illustrates a bottom view (as oriented in FIG. 4A) of the cup dispenser according to some embodiments of the present disclosure.
Figure 4F:
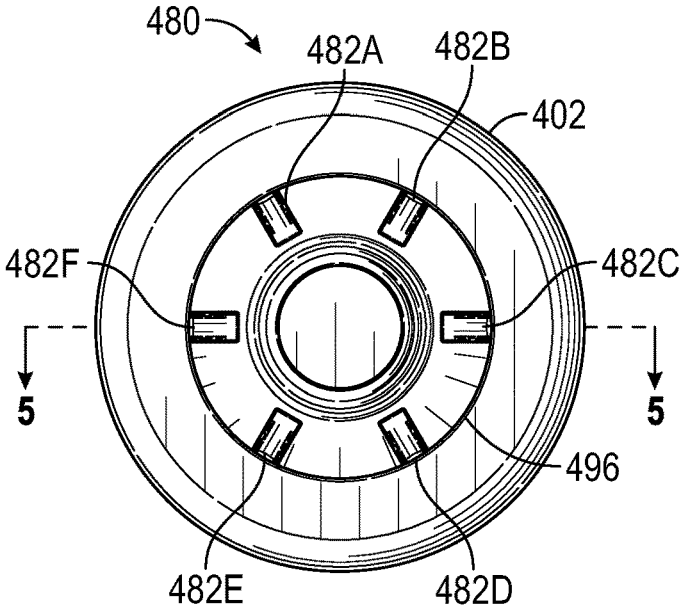
FIG. 4F illustrates a top view (as oriented in FIG. 4A) of the cup dispenser according to some embodiments of the present disclosure.
Figure 4G:
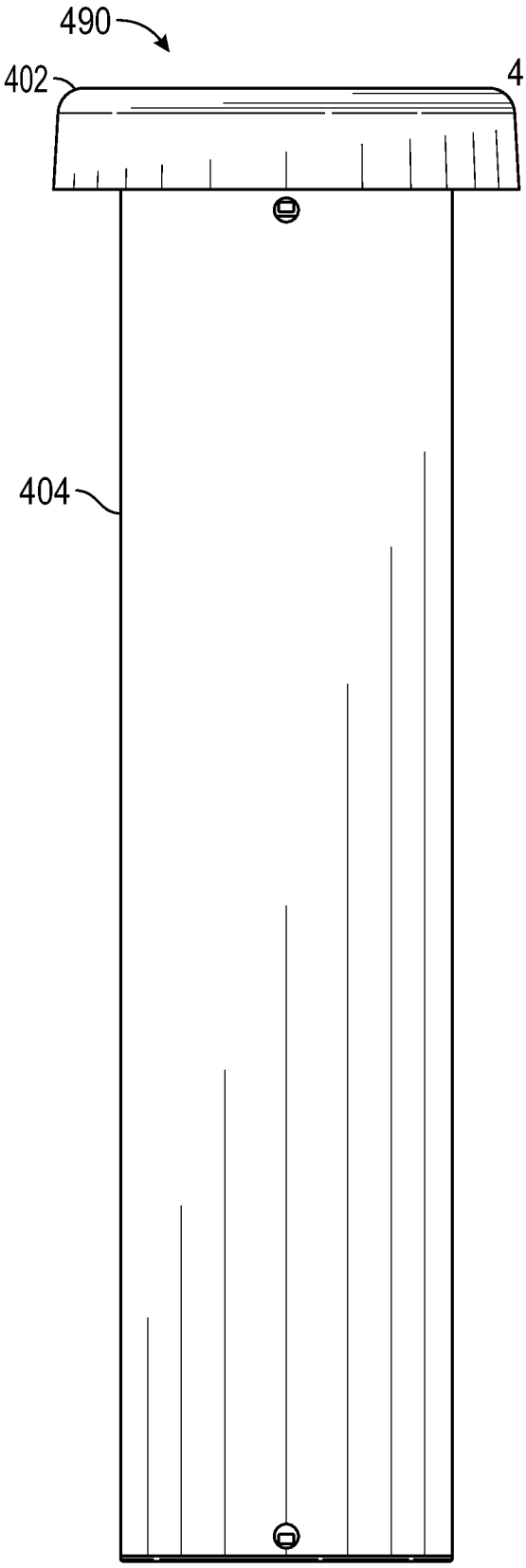
FIG. 4G illustrates a back view of the cup dispenser of FIG. 4A according to some embodiments of the present disclosure.
Figure 5:
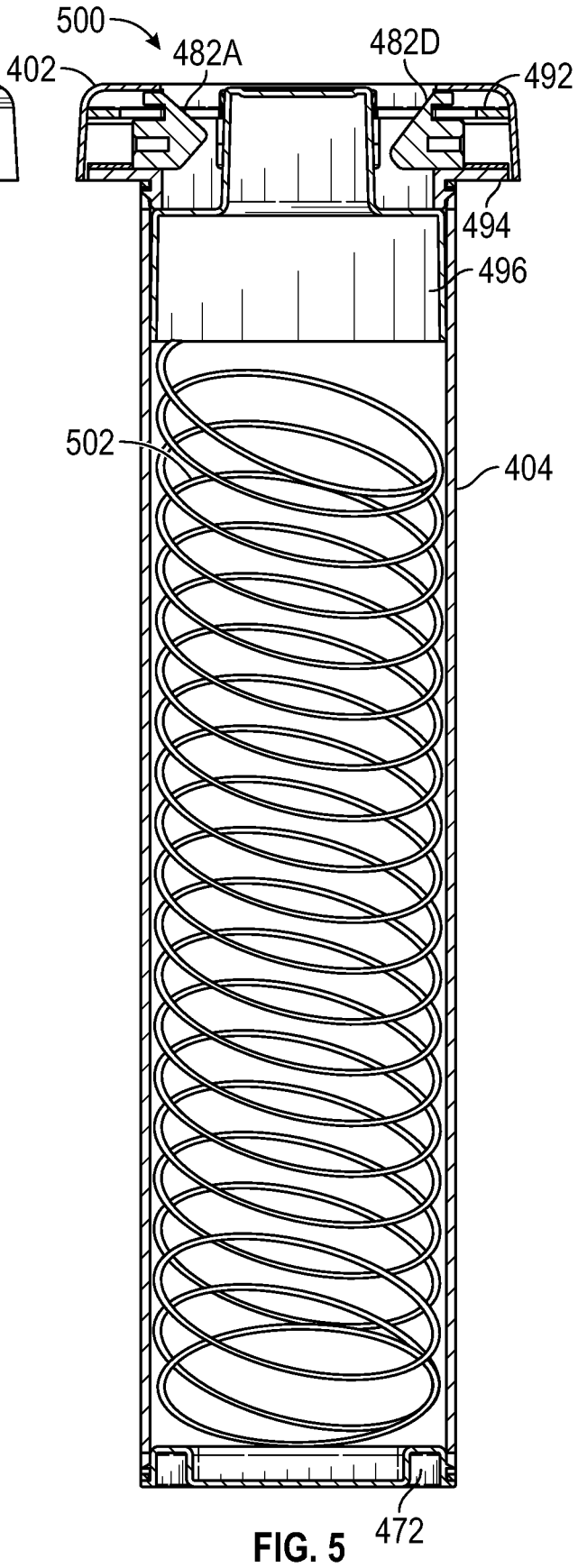
FIG. 5 illustrates a cross sectional view of the cup dispenser of FIG. 4A according to some embodiments of the present disclosure.

FIG. 4A illustrates a perspective view 400 of one embodiment of an automatic self-adjusting cup dispenser. FIGS. 4B-4D illustrate front 420, left 440, and right 460 views, respectively, of a cup dispenser according to some embodiments. FIG. 4E illustrates a bottom view 470 (as oriented in FIG. 4A), and FIG. 4F illustrates a top view 480 (as oriented in FIG. 4A) according to some embodiments. FIG. 4G illustrates a back view 490 according to some embodiments. FIG. 5 illustrates a cross sectional view 500 according to some embodiments. In FIGS. 4A-4D, 4G, and 5, the cup dispenser is oriented upside-down with respect to its typical position for dispensing, since users often prefer to pull down to dispense cups and gravity can assist in causing the cups to protrude properly. This orientation of the figures is for convenience to allow the perspective view (FIG. 4A) to show some of the structure and features inside the dispenser. In some embodiments, the cup dispenser is oriented in a different orientation, such as enabling a user to pull up, down, left, right, diagonal, and/or the like.

Figure 18:
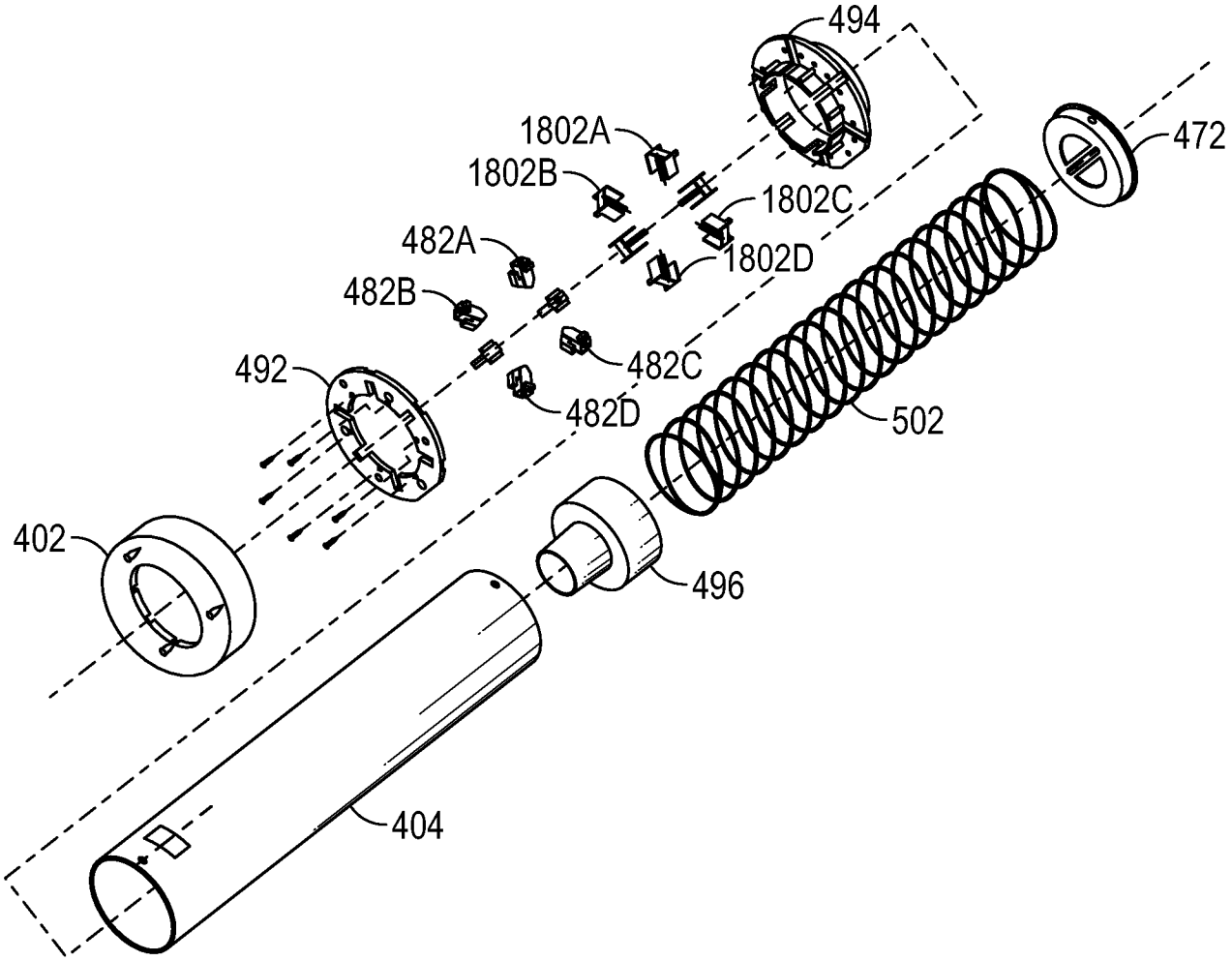
FIG. 18 illustrates an exploded view of a cup dispenser according to some embodiments of the present disclosure.
Figure 19B:
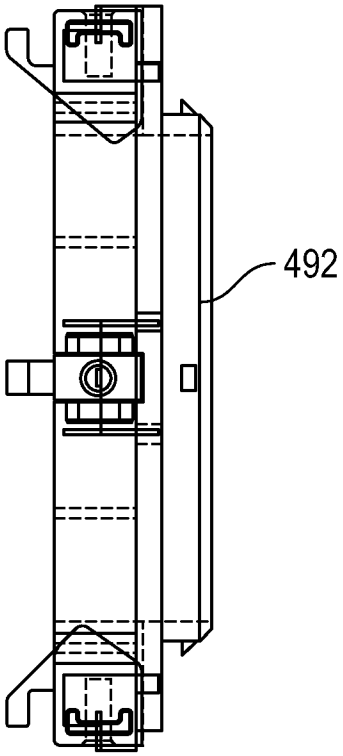
FIGS. 19A-19D illustrate the mounting and carrier plate housing the tracks for the fingers/blocks according to some embodiments of the present disclosure.
Figure 19A:
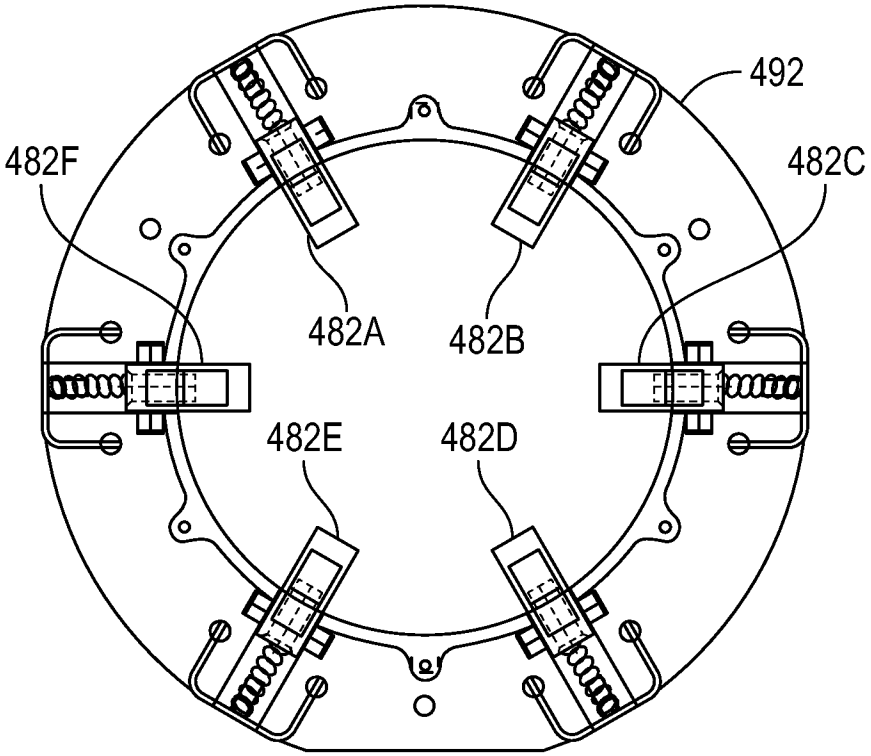
Figures 19C, 19D:
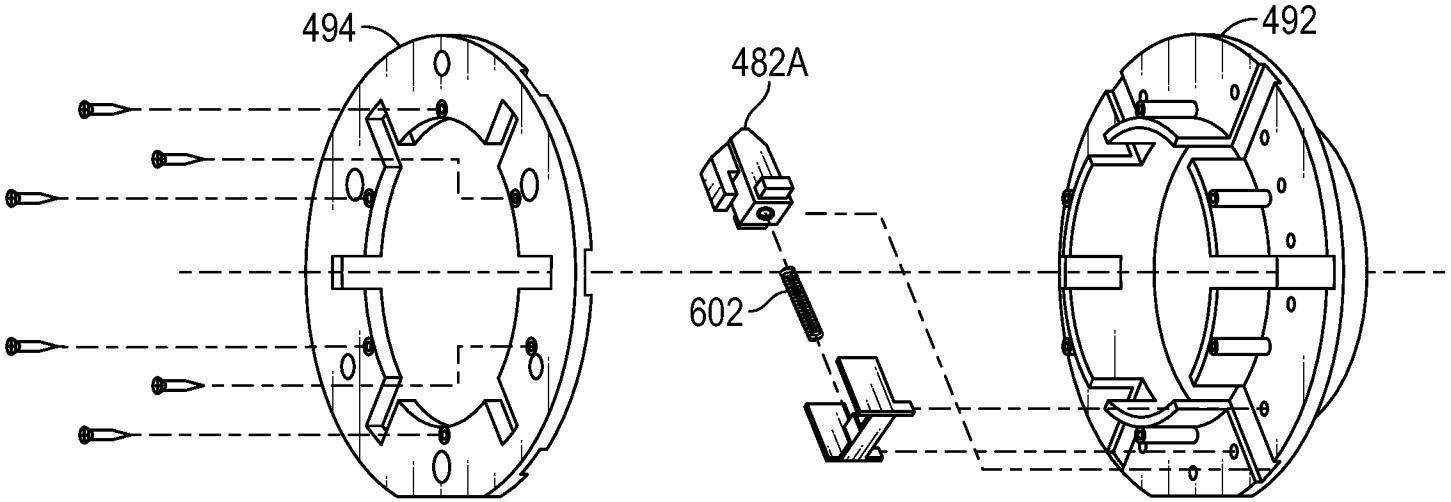

In some embodiments, a cup dispenser can include one or more of the following components (exploded view of an embodiment of a cup dispenser illustrated in FIG. 18):

A. Front Cover (for example, FIGS. 8A, 8B)
B. Mounting and carrier plate (for example, FIGS. 10A, 10B)
C. Top/Slide plate (for example, FIGS. 9A, 9B)
D. Multiple Fingers/Blocks and Multiple compression and/or tension springs (for example, FIGS. 13A, 13B, 13C, 13D, 14A, 14B, 14C, 14D)
E. Cup retainer Tube (for example, FIGS. 17A, 17B, 17C)
F. Rear tube cap (for example, FIGS. 12A, 12B, 12C)
G. Cup plunger (for example, FIGS. 11A, 11B)
H. Cup plunger return spring (for example, FIGS. 16A, 16B)
I. A spring retainer bracket (for example, FIGS. 15A, 15B, 15C, 15D, 15E)

In some embodiments, the front cover 402 can be attached to a mounting plate (such as the mounting plate illustrated in FIGS. 10A, 10B) through use of fasteners, such as split, push and lock fasteners, twist and lock fasteners, or Christmas tree fasteners. The front cover 402 can be configured to receive the sleeve of cups inserted into the cup dispenser and contained within the cup retainer tube 404. A front cover 402 is illustrated, for example, in FIG. 4A, surrounding the top of the dispenser (in the orientation shown). It can provide a pleasing, finished and smooth appearance. It can also provide a barrier against the entry of food or liquid into the moving parts underneath it (e.g., the springs and tracks along which the fingers/blocks slide in and out, as further described elsewhere herein). It can also cover the mounting screws. It can also cover the assembly comprising the mounting and carrier plate and the top/slide plate that together can house the tracks for the fingers/blocks (for example, FIGS. 19A, 19B, 19C, 19D). These components covered by the front cover 402 are visible in other figures, such as FIGS. 5 and 6A-6F.

FIG. 4B shows a side view of the front cover 402 at the top of the cup retainer tube (in this orientation), and demonstrates how the front cover 402 can extend to a greater lateral distance than the width of the tube 404. This can allow the front cover 402 to cover any gap that may exist around the tube 404 in a cabinet into which it may be installed, for example. This can also allow the cover to front cover 402 with additional components that are similarly wider than the cup retainer tube 404 (e.g., the mounting and carrier plate and the top/slide plate). FIG. 4B also shows some holes 406A, 406B, 406C, 406D, 406E in the side of the cup retainer tube 404. These can be useful for manufacturing, installation, drainage, inspection, adjustment, repair, maintenance, and other purposes.

FIGS. 4C-4D and 4G show plane views from different sides having one or more similar features to those discussed with respect to FIG. 4B. As shown, a cup holder can advantageously have a generally cylindrical symmetry for efficient use of space based on the shape of a typical sleeve of cups. In other embodiments, the cup holder can have a different shape, such as a cube, rectangular, and/or other shape.

FIG. 4E shows a plane view of the cap 472 closing off the back (non-dispensing) end of an embodiment of a cup dispenser. It can have a laterally-extending bar that allows an installer to grasp and/or turn the cap. Many other designs are possible. Such an end cap can attach using a threaded or pressure fit, for example, or it can be attached via screws. FIG. 4D shows a hole 406 at the bottom through which a screw or other elongate member can be used to help secure a cap.

FIG. 4F shows a plane view of the dispensing end of an embodiment of a cup dispenser, corresponding to the end shown at the top of FIG. 4A. Six fingers/blocks 482A, 482B, 482C, 482D, 482E, 482F (collectively referred to as fingers/blocks 482) can be seen generally surrounding and extending inward toward the central cup plunger 496 (also referred to as elongate plunger arm). The section lines 5-5 indicate where the section for FIG. 5 was "cut" for purposes of illustration. In some embodiments, the central cup plunger 496 resiliently extends along the length of the tube. For example, a spring attached the central cup plunger applies pressure along the length of the tube pushing the stack of cups toward the entry point for the stack of cups.

In some embodiments, the mounting plate 494 (also referred to as circumferential mounting plate) and carrier plate 492 (also referred to as circumferential carrier plate) is configured to support the moving mechanisms and can be attached to the cabinet or top with screws, such as using three screws. The mounting plate 494 and/or carrier plate 492 can hold one or more parts of the cup dispenser together. For example, the mounting plate 494 and/or carrier plate 492 can be mounted on a cabinet face and/or a counter top into a hole in the cabinet, such as mounted vertically or horizontally. The mounting plate 494 and/or carrier plate 492 can hold the parts of the cup dispenser in correct alignment, such as holding the fingers (and/or blocks) in correct alignment for proper pressure on the cup.

The fingers (also referred to as blocks) 482A, 482B, 482C, 482D, 482E, 482F can comprise resilient protrusions that extend inwardly from the tubular body of the cup dispenser (also referred to as a cup retainer tube 404, elongate tube 404) and be arranged in a ring or spiral that generally surrounds the perimeter of the cups to be dispensed. The resilience of these fingers 482A, 482B, 482C, 482D, 482E, 482F can be tuned using the length, size, and other properties of springs that are configured to cause them to extend inwardly and retract outwardly under pressure from cups that pass by them when pulled by a user desiring to draw out a cup.

In some embodiments, the mounting plate 494 and carrier plate 492 can be manufactured to accommodate multiple fingers/blocks 482A, 482B, 482C, 482D, 482E, 482F. In some embodiments, the multiple fingers and/or blocks 482A, 482B, 482C, 482D, 482E, 482F can be configured to contact the cups stacked within the cup dispenser. The multiple fingers and/or blocks 482A, 482B, 482C, 482D, 482E, 482F can include angles on the front and back of each finger and/or block, some of which are configured to contact the cups and any lips on the cups with a particular pressure. The fingers and/or blocks 482A, 482B, 482C, 482D, 482E, 482F can be retained by the mounting plate 494 and carrier plate 492 with tracks (also referred to herein as sliding tracks) that can move freely in and out extending and retracting through the tracks creating enough space for cups to be pushed into and pulled out of the cup dispenser.

The fingers 482A, 482B, 482C, 482D, 482E, 482F can be extended and retracted with the help of resilient features such as springs 602. In some embodiments, one or more compression and/or tension springs 602 can automatically adjust the pressure applied to the cup. For example, the springs 602 can automatically adjust the pressure to the cup based on the cup's weight applied to the fingers and/or blocks 482A, 482B, 482C, 482D, 482E, 482F holding the cup. The fingers/blocks 482A, 482B, 482C, 482D, 482E, 482F can be pushed toward the center of the dispenser with a tension and/or pressure being applied to the finger/block 482A, 482B, 482C, 482D, 482E, 482F via the compression and/or tension springs 602. The force and/or pressure pushes the fingers/blocks 482A, 482B, 482C, 482D, 482E, 482F toward the center of the dispenser to maintain a specific pressure on the cups allowing the inner most part of the finger's radius tip to apply pressure against the rim and/or bezel of the cups. Thus, individuals can pull the cups from the cup dispensers with the fingers/blocks 482A, 482B, 482C, 482D, 482E, 482F moving out of the way. At the same time, the blocks 482A, 482B, 482C, 482D, 482E, 482F can prevent or block the remaining cups from falling from the dispenser.

In some embodiments, the cup dispenser includes a plurality of sets of fingers/blocks 482A, 482B, 482C, 482D, 482E, 482F set at different depths, at different contact points for the cup(s), and/or applying different pressures on the cup(s). For example, two sets of three blocks 482A, 482B, 482C, 482D, 482E, 482F that are staggered at different depths and with different cup contact points allow one cup to be dispensed via a first set of blocks 482A, 482C, 482E at a first depth while the second set of blocks 482B, 482D, 482F at a second depth help retain the next cup in place for future dispensing. By positioning a set of fingers designed to contact larger cups deeper within the dispenser and a set of fingers designed to contact smaller cups closer to the opening of the dispenser (where deeper and closer are relative positions generally along the tubular axis), the two types of cups can generally extend out of the dispenser to the same extent while their relative upper portions that are retained by the fingers are positioned at different depths therein. Pressure from the springs 602 and or elastic bands can maintain the fingers 482A, 482B, 482C, 482D, 482E, 482F in such a way that force is evenly applied by the fingers/blocks 482A, 482B, 482C, 482D, 482E, 482F to hold the cup in place until the time comes for the next cup to be dispensed.

Fingers 482A, 482B, 482C, 482D, 482E, 482F interact with the cups initially to retain a stack or sleeve of cups.

Fingers 482A, 482B, 482C, 482D, 482E, 482F also dispense cups one at a time, when pulled by a user. To do this, some embodiments of the fingers 482A, 482B, 482C, 482D, 482E, 482F allow one cup to be pulled out by resiliently compressing outwardly to allow a lip of the pulled cup to be removed from the dispenser. Immediately thereafter, however, the operative fingers 482A, 482B, 482C, 482D, 482E, 482F resiliently slide inwardly back toward the axis of the tube in order to prevent the next cup from being pulled out along with the initial cup (due to the functional suction present between them). The shape of the inward-most (or otherwise cup-contacting) tip of the finger(s) 482A, 482B, 482C, 482D, 482E, 482F can have a shape and material that is configured to perform this function repeatedly and reliably over numerous iterations. Some such shapes are shown in the illustrations that accompany this disclosure. Various shapes, tapers, and materials can be provided, various fingers designed to interact well with various types of cups.

The fingers 482A, 482B, 482C, 482D, 482E, 482F illustrated in the cross-sectional view of FIG. 5 show two different tapers that may interact with cups differently. The finger 482A at the left has a longer and more immediate taper that encounters a cup lip initially. The second finger 482D has a shorter taper facing generally toward the rear tube cap (at the bottom of the tube in this orientation but typically toward the top of the tube). The angle of the tapes of the two fingers 482A, 482D are also different. In some embodiments, a finger or set of fingers can act to allow the cups to come out more readily, while a different finger or set of fingers acts to retain the remaining cups more effectively. These functions of particular fingers can change, depending on the cups being dispensed. Fingers/blocks 482A, 482B, 482C, 482D, 482E, 482F having both upward and downward tapers can allow for both cup loading and cup dispensing from the same dispensing end of a cup dispensing device or system.

FIG. 5 is a cross section taken along the lines 5-5 of FIG. 4F. As shown, the cup retainer tube 404 can provide a space for receiving a stack of cups within it. The cup plunger return spring 502 can be located within this space. The cup plunger return spring 502 can be located within a spring rod (see FIG. 6D) or other resilient elongate mechanism configured to be compressed and exert force along the elongate axis of the tube. FIG. 5 also shows a cross section of the cup plunger, located toward the top of the drawing. In this embodiment, it includes a larger cylindrical portion and a smaller cylindrical portion, with a disk-shaped shelf connecting the two. The shelf can be configured to contact a lip of the top cup in a stack of cups, thereby supporting and pushing the stack toward the dispensing end. The smaller cylindrical portion can extend into an opening of a cup. A section of two different finger/block types is shown, protruding inwardly toward the smaller cylindrical portion of the cup plunger. Each of these fingers/blocks 482A, 482B, 482C, 482D, 482E, 482F includes a small laterally-extending void that is configured to receive and retain a small coil spring, each configured to urge the fingers/blocks inwardly but resiliently pass outwardly as needed to accommodate passing cups. These springs can also be supported toward the outer circumferential edge of the cup dispenser by protrusions from U-brackets (e.g., formed from metal). See FIGS. 6A, 6B, 6E, and 6F.

These finger/block mechanisms, and their supporting structure, can have the benefit of avoiding maintenance or adjustment and repairs that may be necessitated by the types of designs illustrated in FIGS. 1A, 1B, 2, and 3.

In some embodiments, the rear tube cap (see FIGS. 4E and 5) provides a barrier 472 to stop the cup sleeves (or stacks of cups) from coming out the back of the dispenser. The cup plunger return spring 502 can be attached near the back of the dispenser near or on the rear tube cap 472, and this spring 502 can apply pressure to the cup sleeve to be pushed toward the front cover 402 where the cups are to be dispensed. The spring 502 can push the cups until the cups are stopped by the pressure applied by the blocks 482A, 482B, 482C, 482D, 482E, 482F. The cap 472 can provide an attachment point for a cup plunger return spring or spring rod 502, for example. The cap 472 can also provide a means for loading cups into the cup retainer tube from the end opposite the dispensing end. In some embodiments, however, the cap 472 remains in place and loading of new cups can occur through the same opening use for dispensing cups.

Figure 6A:
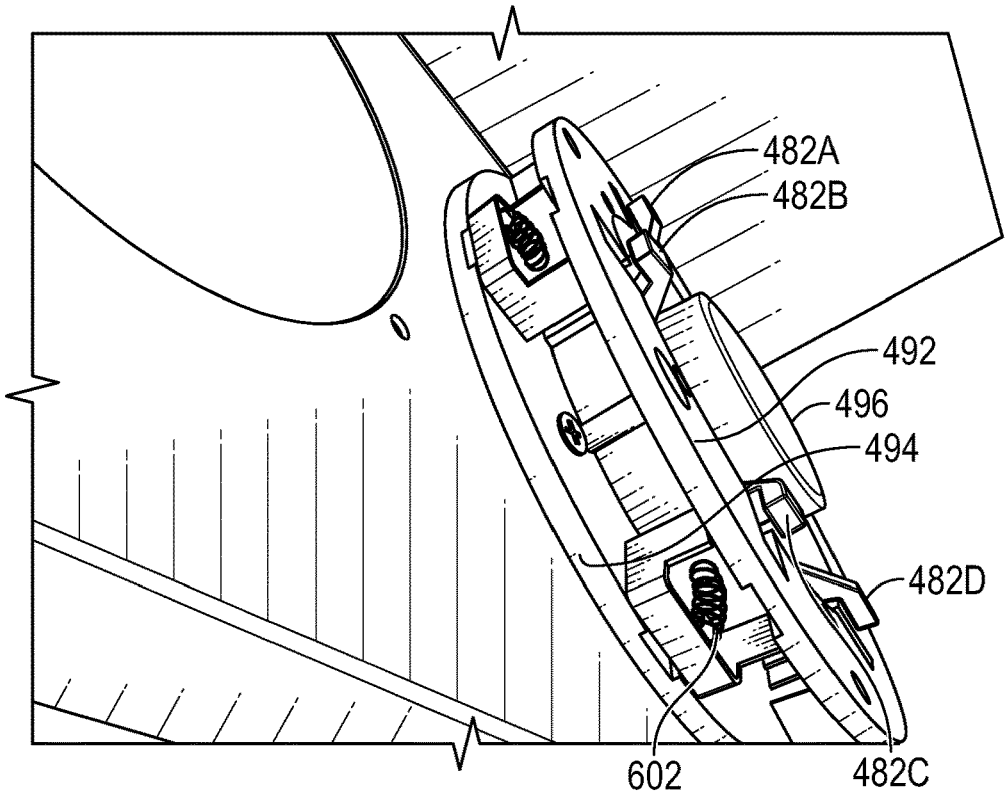
FIGS. 6A-6F show various views of a cup dispenser as installed according to some embodiments of the present disclosure.
Figure 6B:
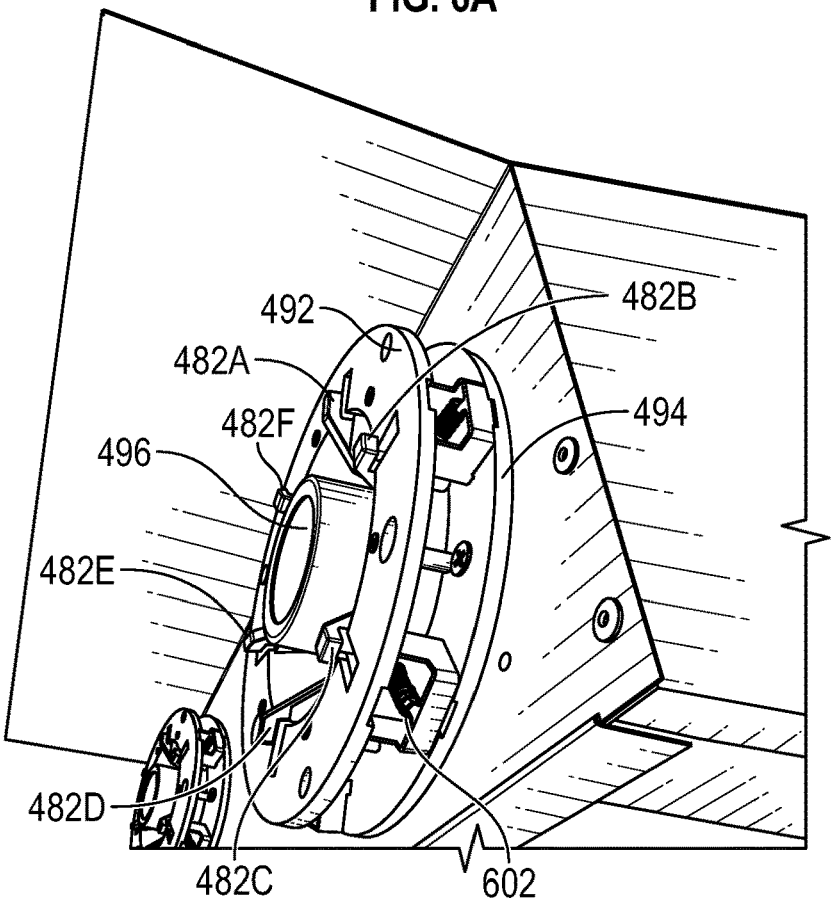
Figure 6C:
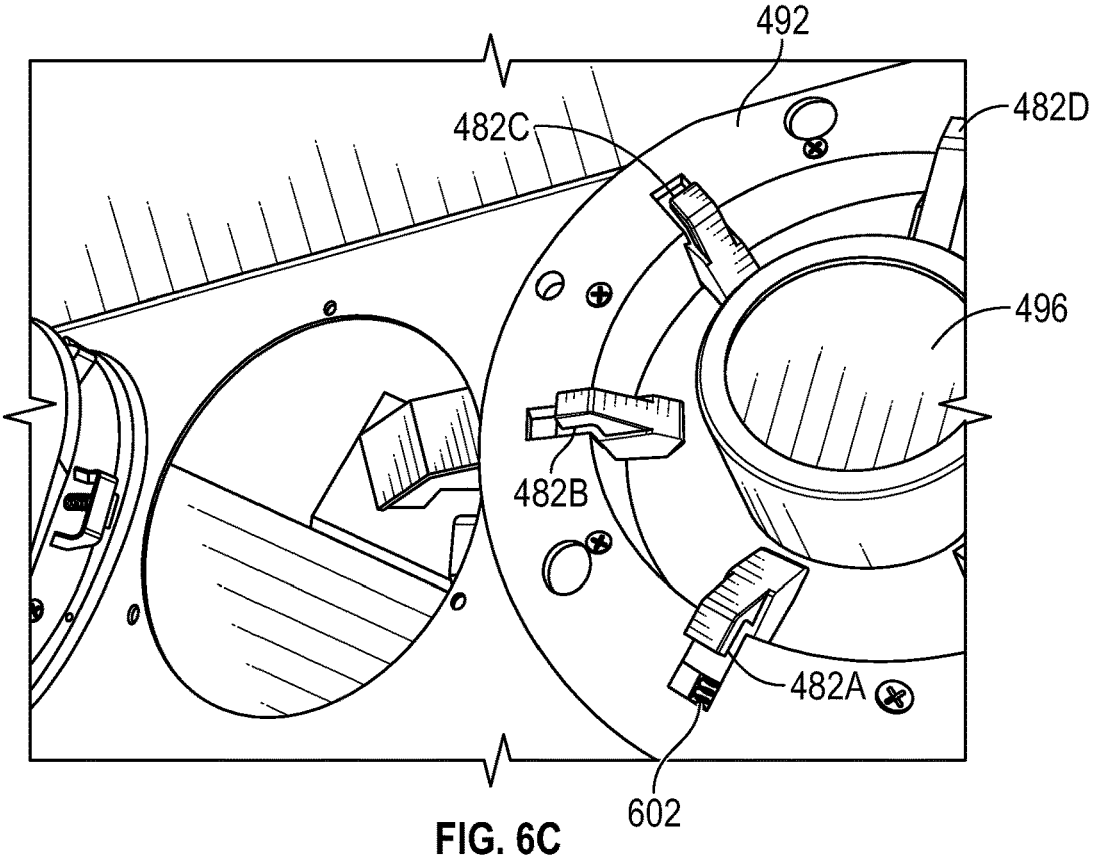
Figure 6D:
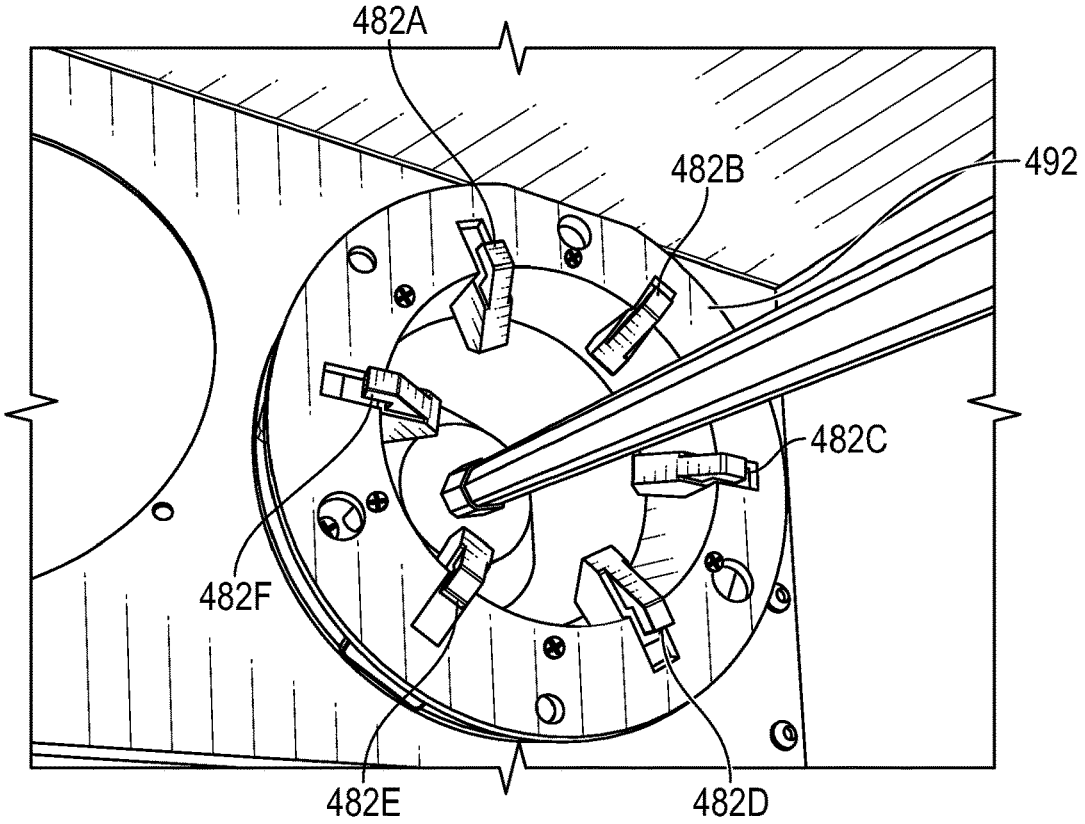
Figure 6E:
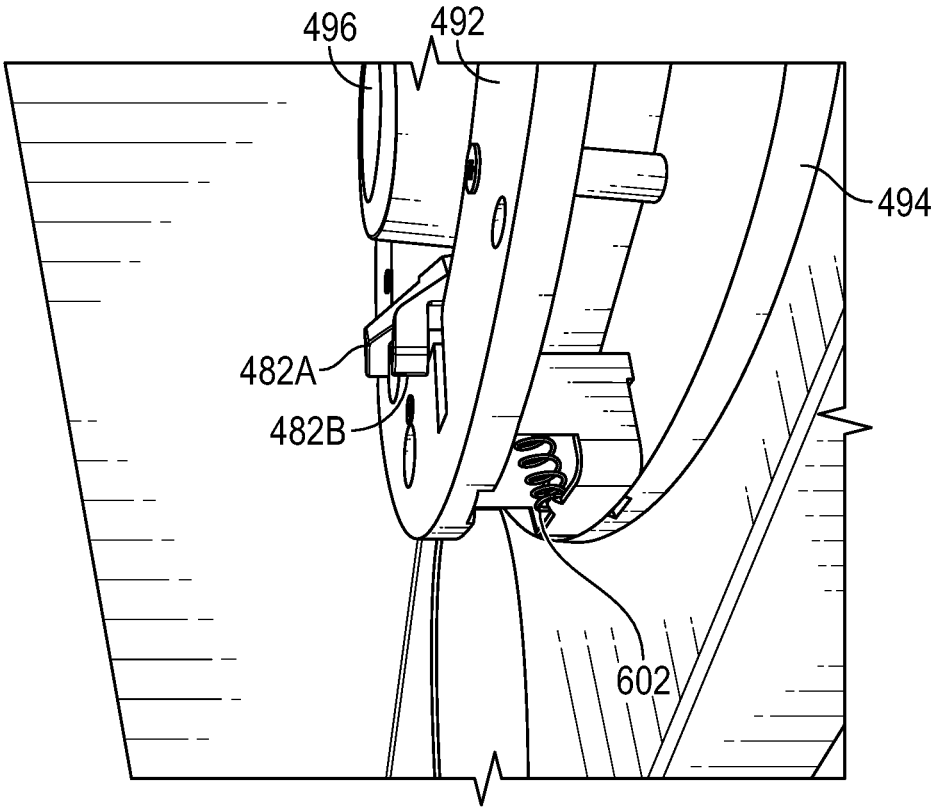
Figure 6F:
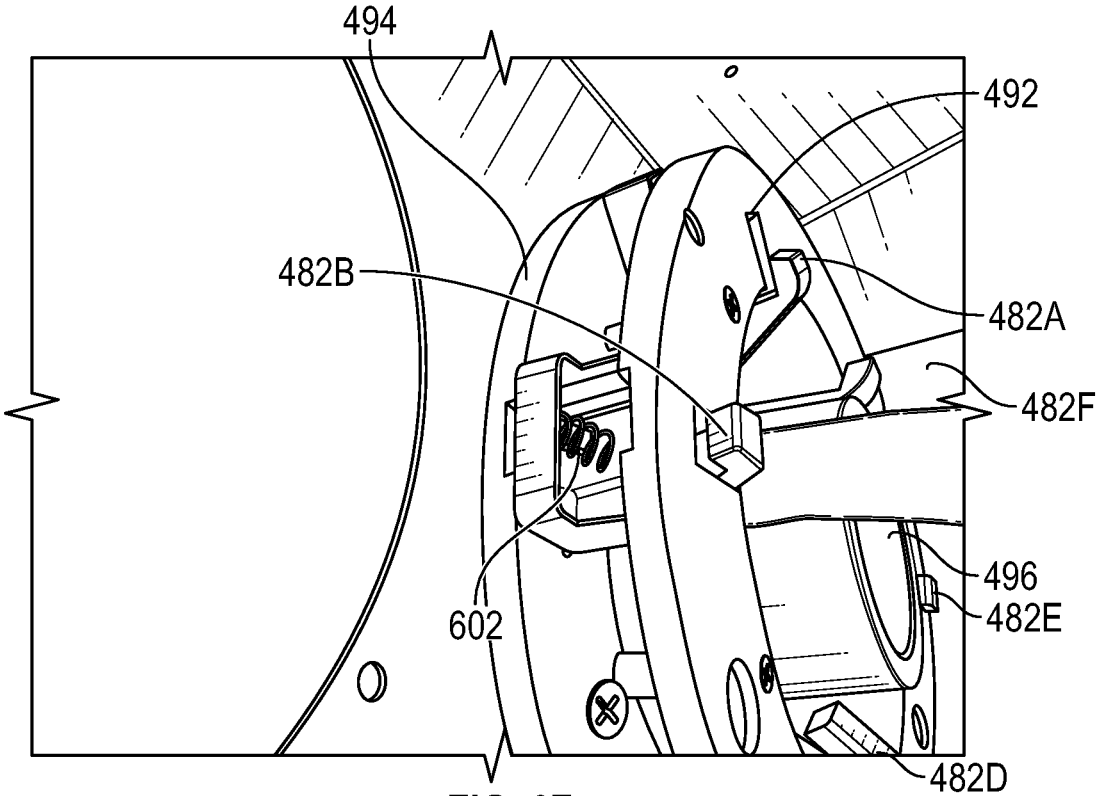

FIGS. 6A-6F show various illustrations of a cup dispenser as installed. The angle of FIGS. 6A-6B allow a view of springs positioned behind two of the fingers/blocks and retained by a tab protruding inward as part of a generally U-shaped metal bracket. A mounting screw is also visible holding the mounting and carrier plate into the metal cabinet. FIG. 6C shows a view of the top/slide plate surrounding a central cup plunger with radially-positioned fingers/blocks and a spring peeking out behind one of the fingers. FIG. 6D shows a similar view but with the central cup plunger extended for purposes of the photograph. FIG. 6E shows another side view close-up of the bracket retaining the spring and supporting a sliding finger/block, and FIG. 6F shows a human finger pushing back the finger/block so that the spring compressed. Visible beneath the bracket supporting the finger/block in each of FIGS. 6A-6B, and 6F is a void or slot within the mounting and carrier plate, through which a protrusion or tab that forms part of the finger/block is allowed to slide as it moves inwardly and outwardly. This forms one portion of the track that constrains unwanted movement of the fingers/blocks. The two plates (the mounting and carrier plate and the top/slide plate) each have corresponding voids that together form a track as the plates flank the fingers/blocks as shown. Spacer struts are provided (and may be formed integrally with one or more of the plates, as shown). These spacer struts and the U-shaped metal brackets together help maintain the plates at a uniform spacing from one another, as shown in the illustrations of FIGS. 6A-6B and 6E-6F.

Figure 7:
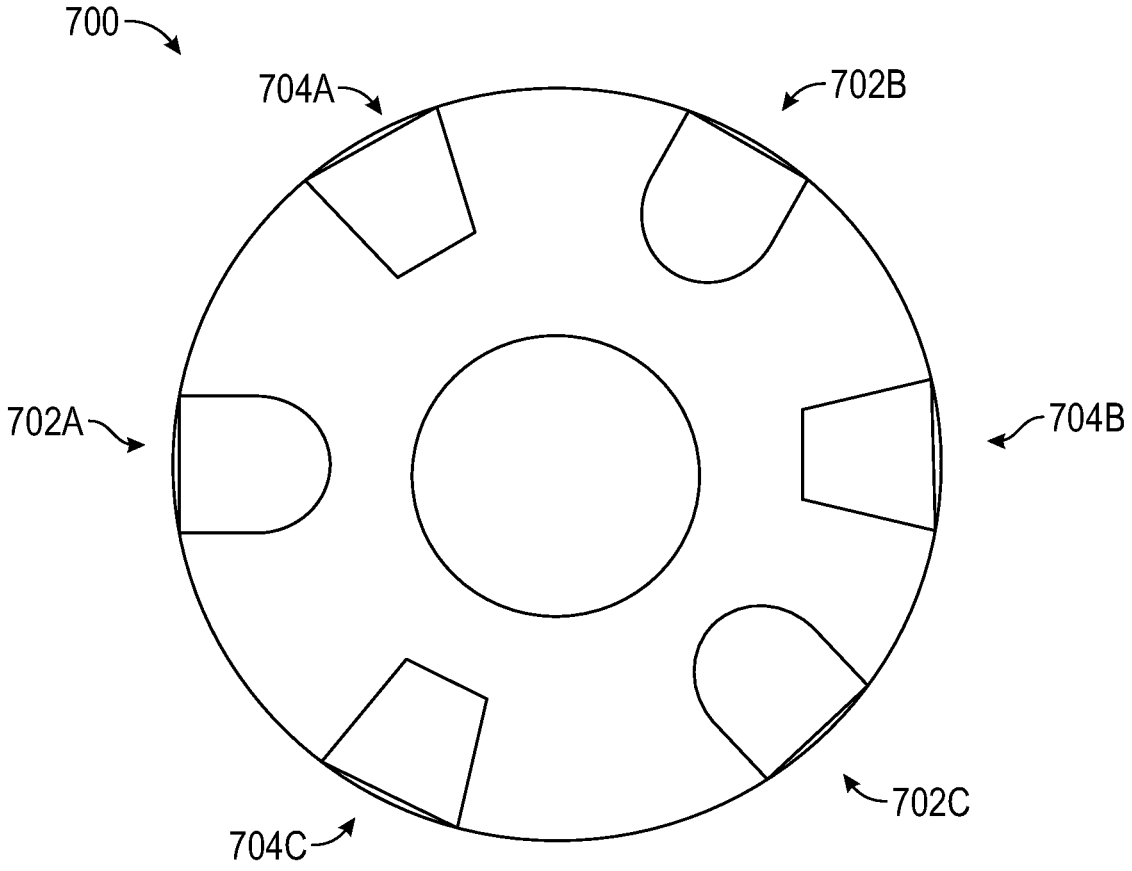
FIG. 7 illustrates two sets of blocks for a cup dispenser according to some embodiments of the present disclosure.

FIG. 7 schematically illustrates two sets of fingers/blocks for a cup dispenser 700. The first set can include three fingers/blocks 702A, 702B, 702C (collectively referred to herein as the first set 702). The second set can include three fingers/blocks 704A, 704B, 704C (collectively referred to herein as the second set 704). The two sets are interspersed and alternate with each other around the perimeter of the cup dispenser. Although only illustrated schematically here, the first set 702 can be similar within the set and optimized for one type of cup, whereas the second set 704 can also be similar within the set and be optimized for another type of cup. For example, the sets can be optimized for a particular shape of a cup (such as a cone and flat bottom), a size of a cup (such as small and large), a cup material (such as Styrofoam or plastic), and/or other characteristic of a cup. Such optimization can include the types of materials used for the body and or surfaces of the fingers blocks (and their sliding and static friction properties when interacting with the relevant cup materials and surface shapes). Such optimization can also include the shape, contours, and angles of the surfaces of the fingers/blocks. Such optimization can include the size, resilience, location, and other properties of any springs associated with the fingers/blocks, as well as the extent to which the fingers/blocks are configured to protrude at various times and under various conditions. In some embodiments, the fingers/blocks can be spaced at regular angular distances. For example, the blocks in the first set 702 can be separated by 120 degrees, and the blocks in the second set 704 can be separated by 120 degrees.

In some embodiments, the cup dispensers disclosed herein can be used in gas stations, convenience stores, restaurants, fast food restaurants, cafeterias, and/or other locations that desire to dispense cups to the public and/or to employees. Many embodiments can be formed entirely from ABS plastic. Some embodiments can be formed from stainless steel, for example in cafeteria settings or others that desire the cleanable or cosmetic properties of stainless steel.

In some embodiments, the cup dispenser can be of varying lengths, such as 24" long or 18" long. The length can be configured to accept standard cup stack quantities and/or sizes. The length can be configured to accept the longer stacks and address shorter stacks using an accommodating spring or gravity system (e.g., a cup plunger return spring).

In some embodiments, the compression and/or tension springs 602 and/or the cup plunger return spring 502 can comprise different types of coil springs. For example, the spring can include a coil spring, a metal spring, a tempered spring, an elastic band, and/or other mechanism to apply tension against the cups or control the sleeve of cups inserted into the cup dispenser. The dispenser can also use or harness gravity to assist in urging cups to protrude from the dispenser when they are available.

In some embodiments, the material for one or more components of the cup dispenser can be made from plastic, metal such as stainless steel or aluminum, and/or other material. For example, one or more components of the cup dispenser can be made of one or more of a plastic, such as Polyethylene terephthalate (PET or PETE), High-density polyethylene (HDPE), Polyethylene (PE), Polyvinyl chloride (PVC), Low-density polyethylene (LDPE), Polypropylene (PP), Polystyrene (PS), Polylactic Acid (PLA), Acrylonitrile Butadiene Styrene (ABS), Polycarbonate (PC), Acrylic (PMMA), Acetal (Polyoxymethylene, POM), Nylon (PA), and/or the like. In some embodiments, at least a portion of one or more components of the cup dispenser can comprise one or more of: recycled Polypropylene feedstocks, clarified polypropylene, impact resistant modified polypropylene (e.g., synthetic rubber, metalecines, EVA, elastomers, etc.), plant-based polymers, thermal plastics, and high density polyethylene (HDPE) for low temperature impact performance. HDPE has the advantage of being inert and therefore compatible with a variety of compounds. Thus, testing of compatibility with HDPE may be reduced or avoided. HDPE is also reasonably priced.

In some embodiments, the one or more components of the cup dispenser can be made by co-injection technology to incorporate recycle feedstock as a multi-layer structure. Co-injection technology can include uniting two or more individual melt streams to make a single article or material.

In some embodiments, the cup dispenser can include drain points for unintentional spills of liquid. Such drain points can be included on portions that are intended to be installed toward the bottom of the dispenser—for example in the front cover 402, in some embodiments.

In some embodiments, a universal cup dispenser design can be configured to accept many different cup sizes by configuring multiple fingers to all accommodate different cup sizes through their ability to extend resiliently inwardly to a greater or lesser degree, combined with their tapered shape that can interact effectively with (e.g., slide along or support) various cup lips and cup tapers. In some embodiments, different fingers can be configured to operatively interact with different cup types and sizes. In some embodiments, different tiers, sets, or ranks of fingers can be configured, each to operatively interact with a different type of cup (while other tiers, sets, or ranks may passively interact therewith if they are not designed or intended to interact with the specific size or type of cup in question). Thus, as a cup proceeds along the length of the tube, its outer surface(s) (e.g., its widest portion or lip) can interact with numerous fingers, some of which allow it to pass with little resistance, while others are more effective to block or retain the cup. Thus, a sequential series of fingers can be used to achieve similar functions for various cup types. Accordingly, a universal cup dispenser can use controlled resilience in a radial direction and variety of surfaces, shapes, and contact points in an axial direction, to allow for dispensing of multiple sizes and types of cups.

Another aspect of the described embodiments that allows for holding and dispensing of multiple cup types is the shape and surfaces of a cup plunger. In some embodiments, a cup plunger can have one or more surfaces that interface to be perpendicular with the top lip of the top cup in a stack of cups. Thus, the plunger can move back and forth under the influence of a cup plunger return spring, tending to urge the stack of cups toward a central opening in the front cover 402 between the multiple fingers/blocks, no matter how many cups remain in a given stack of cups. Thus, the stack of cups can be urged perpendicularly by a surface of the cup plunger. In some embodiments, a cup plunger can have one or multiple circumferential surfaces, each tapered at least slightly inwardly as they extend toward the opening of the dispenser. A surface having a larger radius of curvature can be used for larger cups, and a surface having a smaller radius of curvature can be used for smaller cups. The taper of each surface can be used to more finely address and interface with particular cup radii. Thus, in some embodiments, a plunger can extend into the opening of a top cup in a stack of cups and nest therein, tending to maintain the position of the stack of cups aligned with a central axis of a cup retainer tube.

Figure 8B:
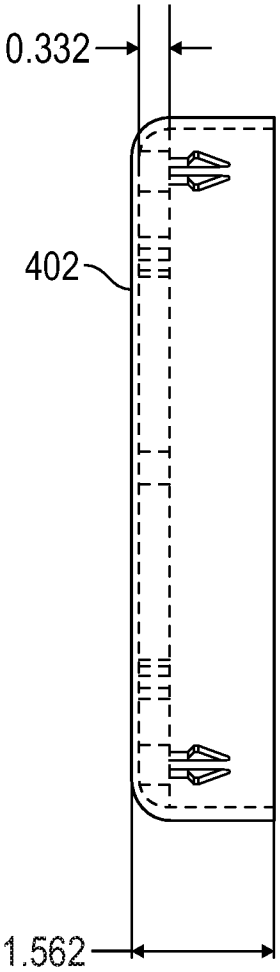
FIGS. 8A-8B illustrate a front cover for a cup dispenser according to some embodiments of the present disclosure.
Figure 8A:
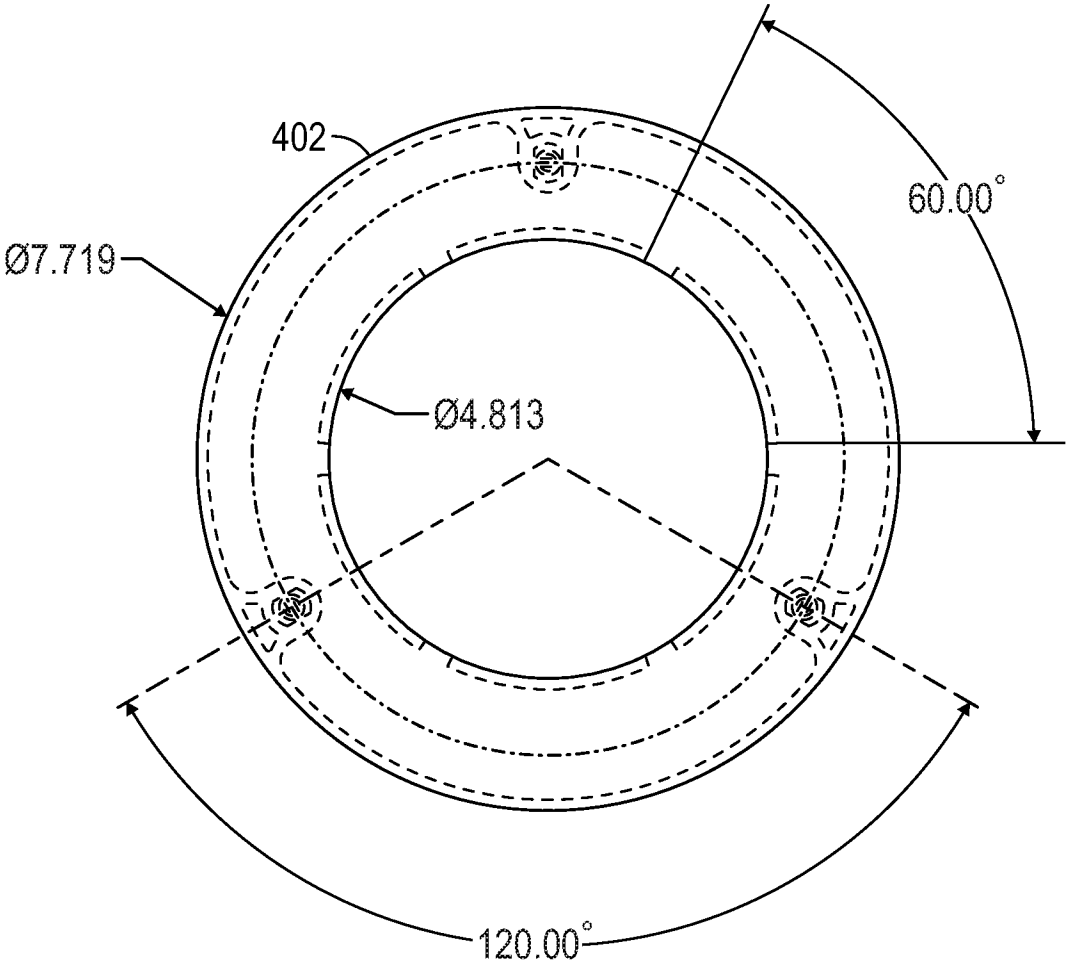
Figure 9B:
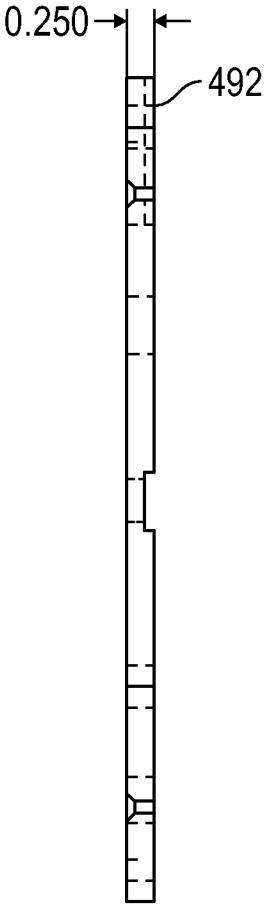
FIGS. 9A-9B illustrate a top/side plate for a cup dispenser according to some embodiments of the present disclosure.
Figure 9A:
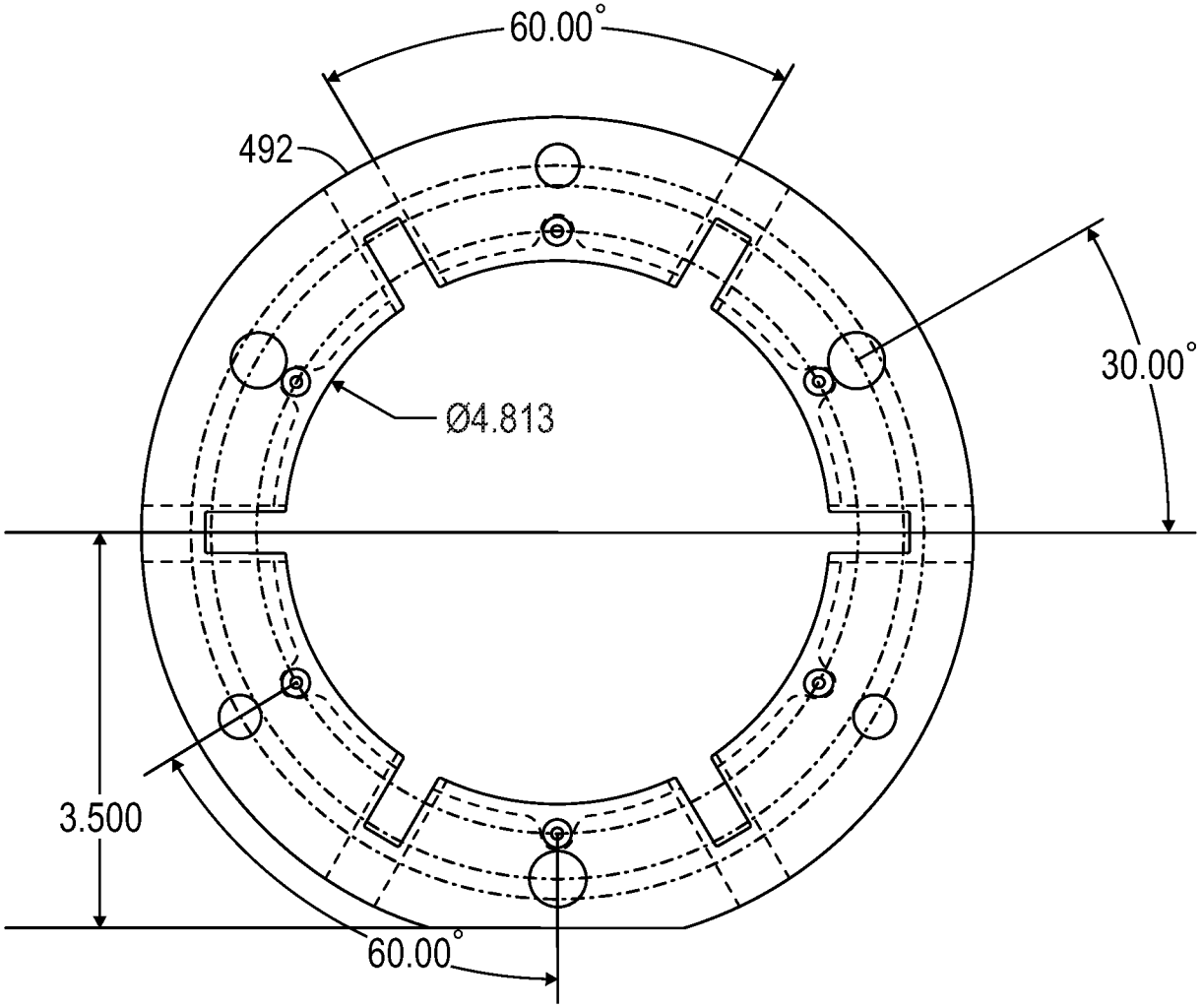
Figure 10B:
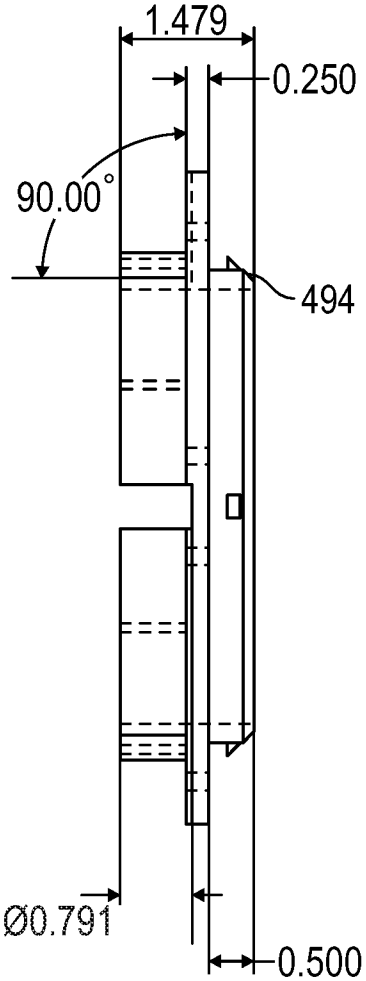
FIGS. 10A-10B illustrate a mounting and carrier plate for a cup dispenser according to some embodiments of the present disclosure.
Figure 10A:
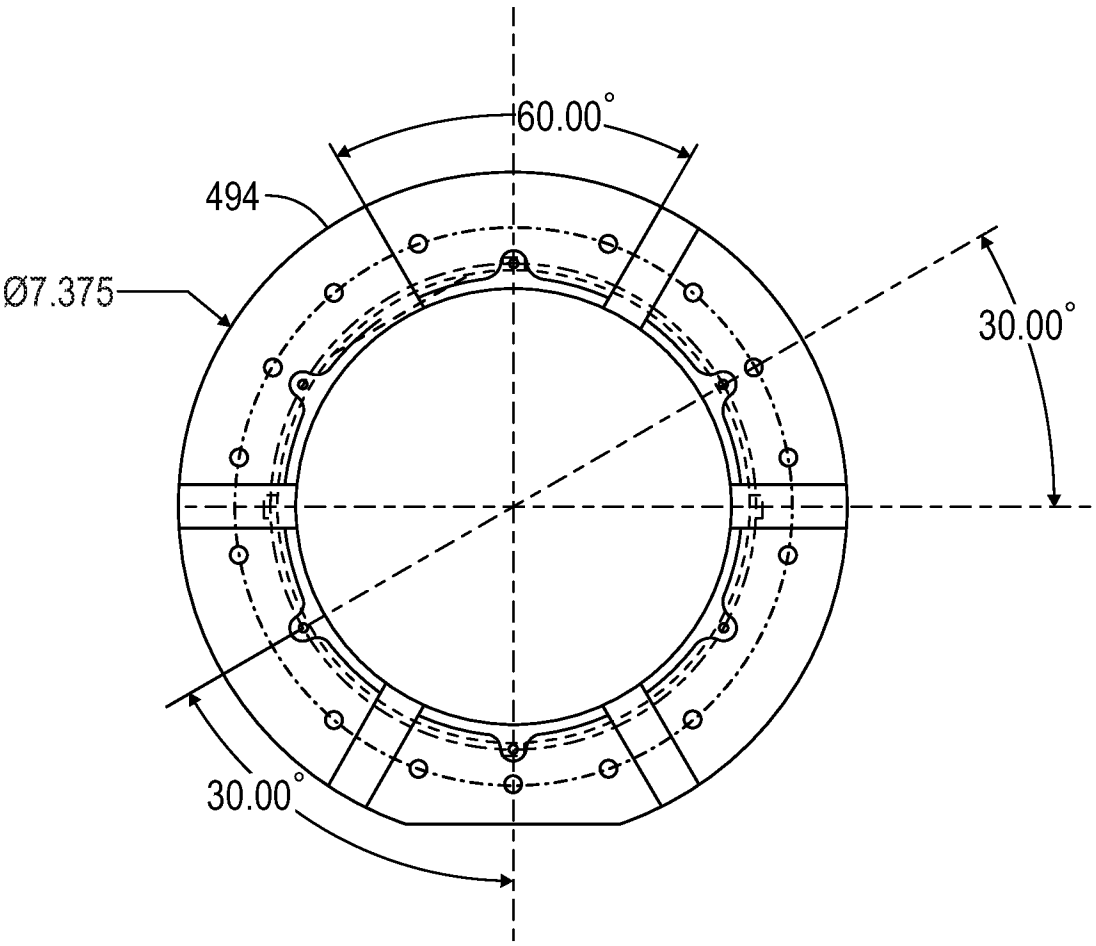
Figure 11B:
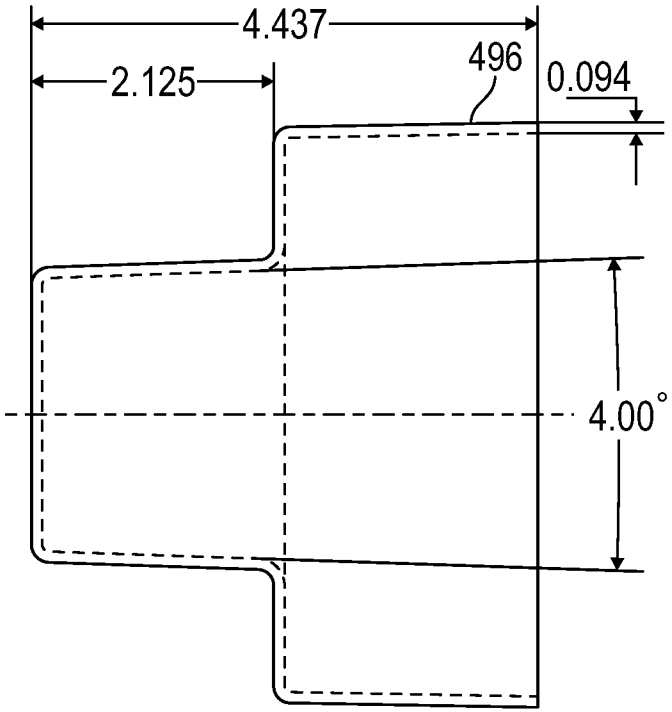
FIGS. 11A-11B illustrate a cup plunger for a cup dispenser according to some embodiments of the present disclosure.
Figure 11A:
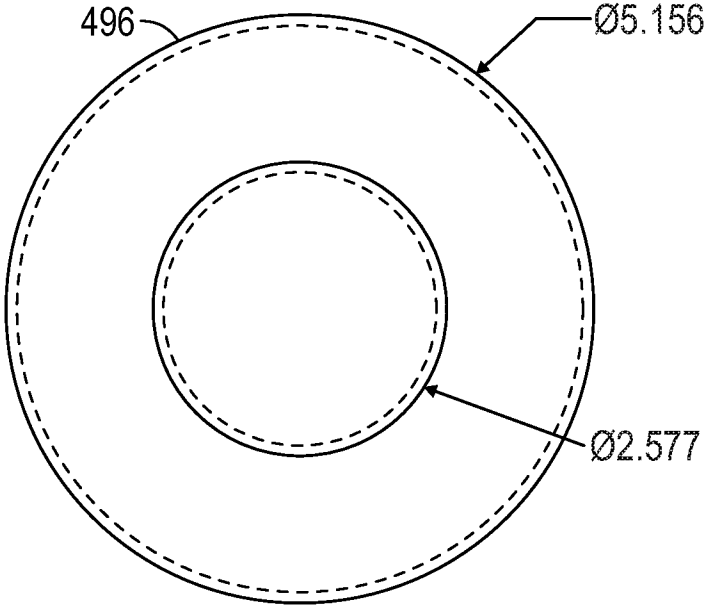
Figure 12B:
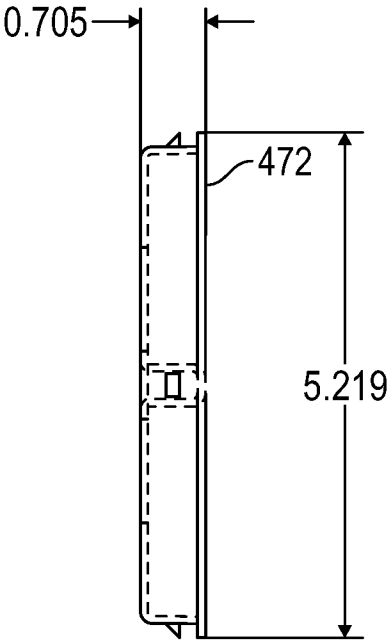
FIGS. 12A-12C illustrate a rear tube cap according to some embodiments of the present disclosure.
Figure 12A:
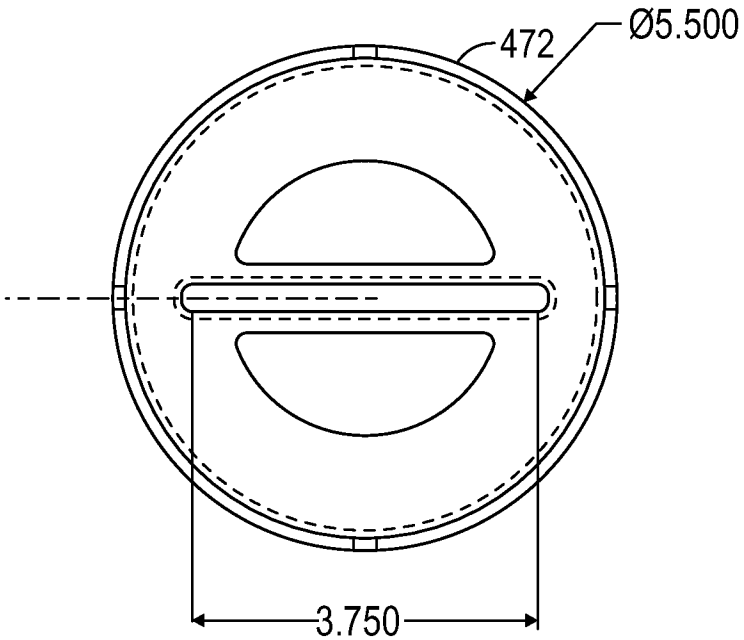
Figure 12C:
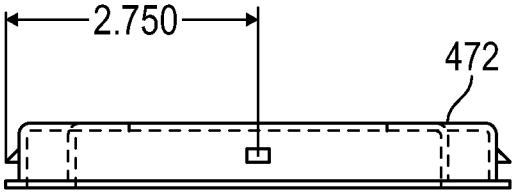
Figure 13A:
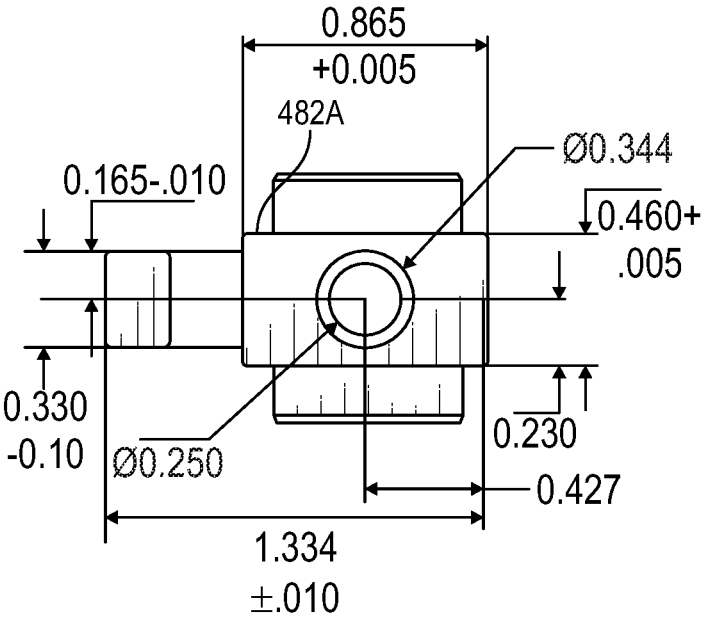
FIGS. 13A-13D and 14A-14D illustrate fingers/blocks and compression and/or tension springs according to some embodiments of the present disclosure.
Figure 13B:
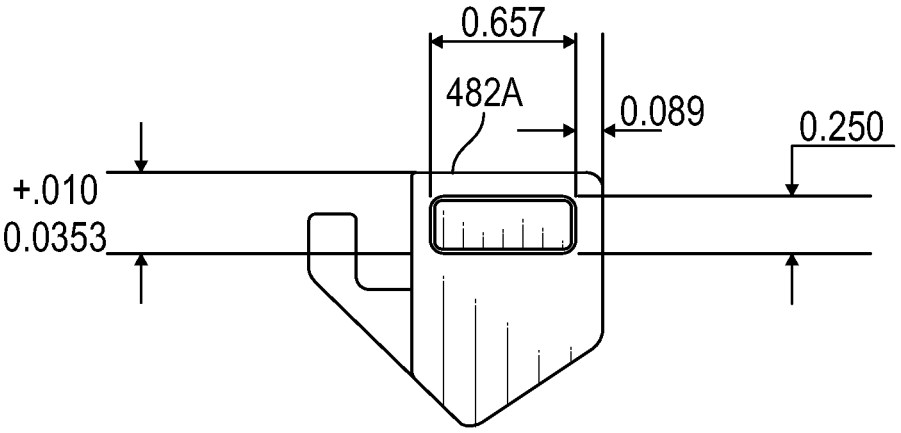
Figure 13C:
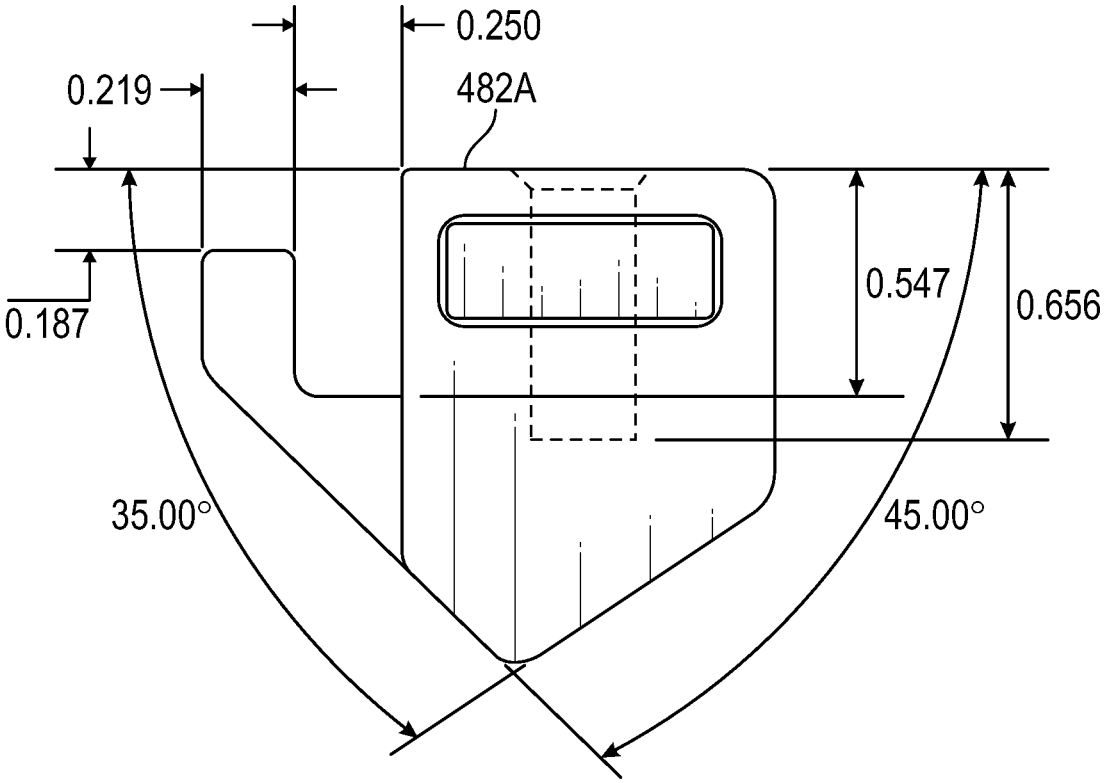
Figure 13D:
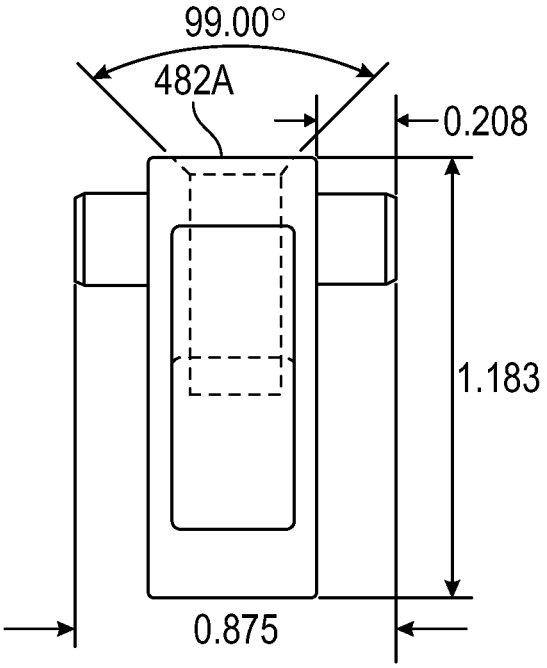
Figure 14A:
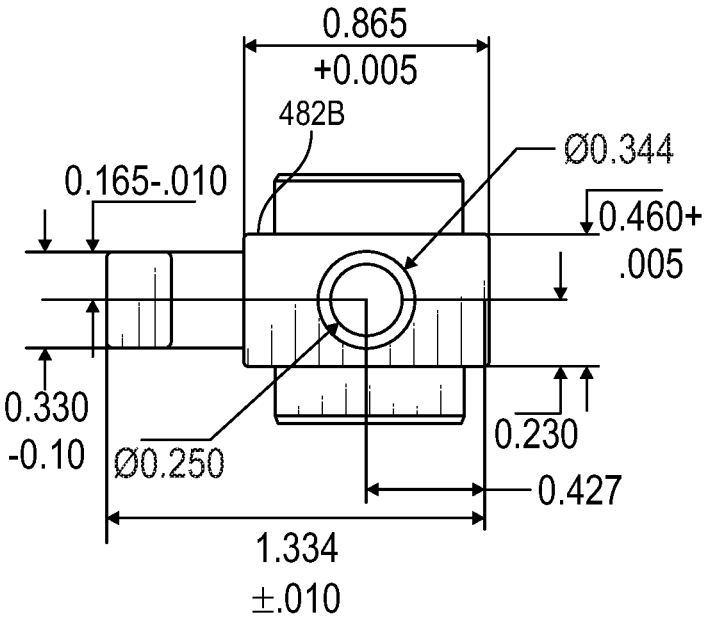
Figure 14B:
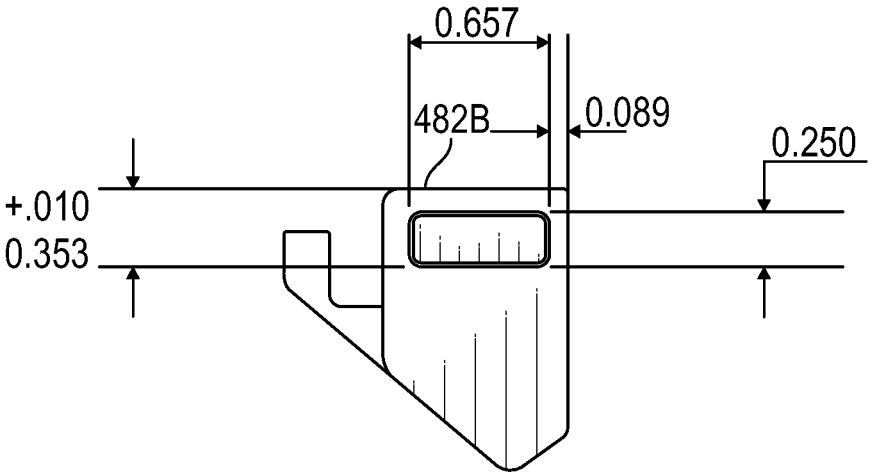
Figure 14C:
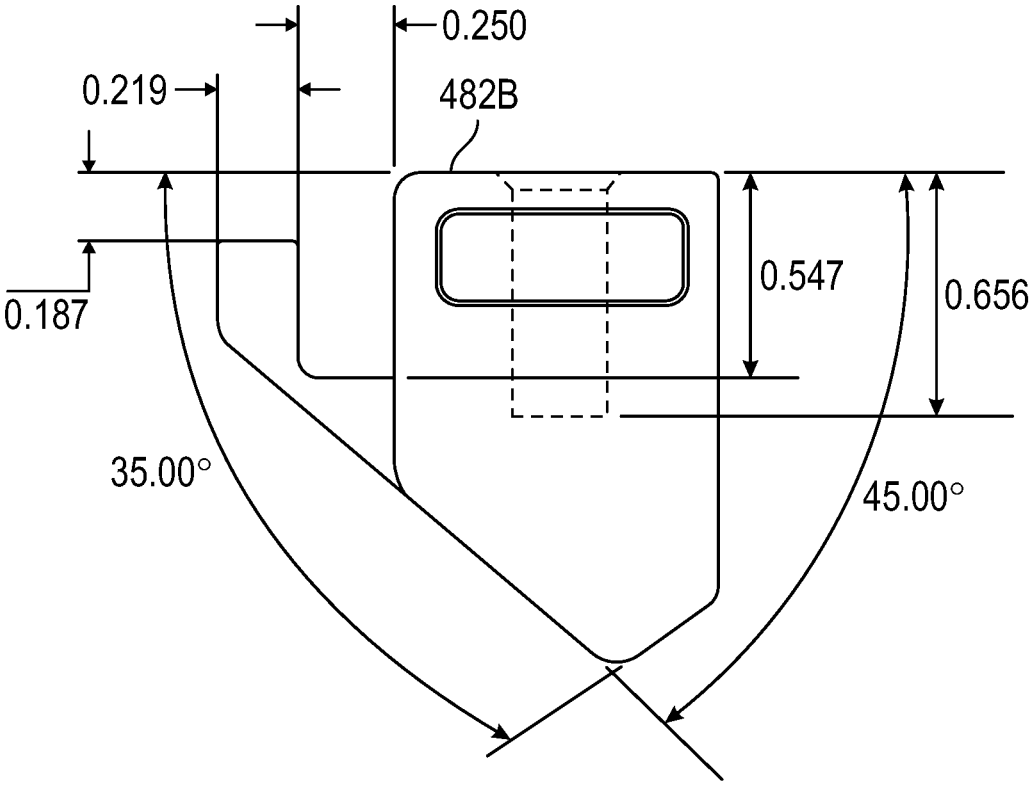
Figure 14D:
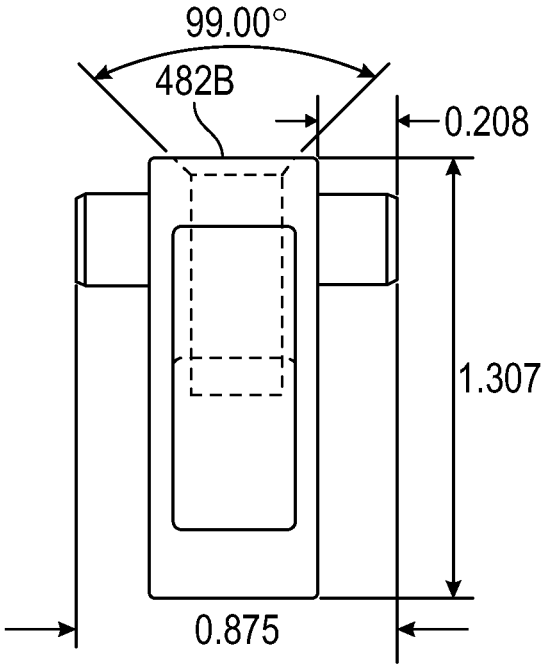
Figure 16A:
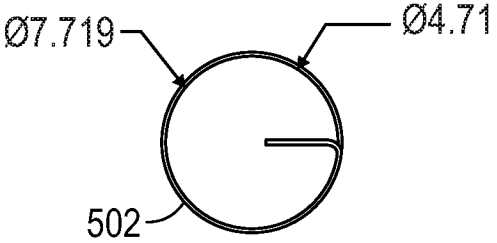
FIGS. 16A-16B illustrate a cup plunger return spring according to some embodiments of the present disclosure.
Figure 16B:
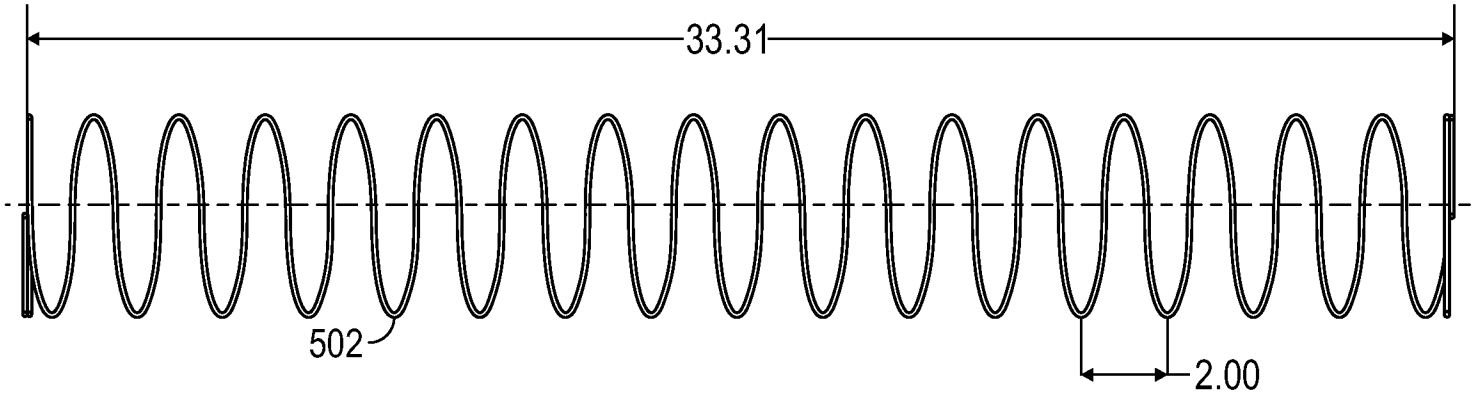
Figures 17A, 17B, 17C:
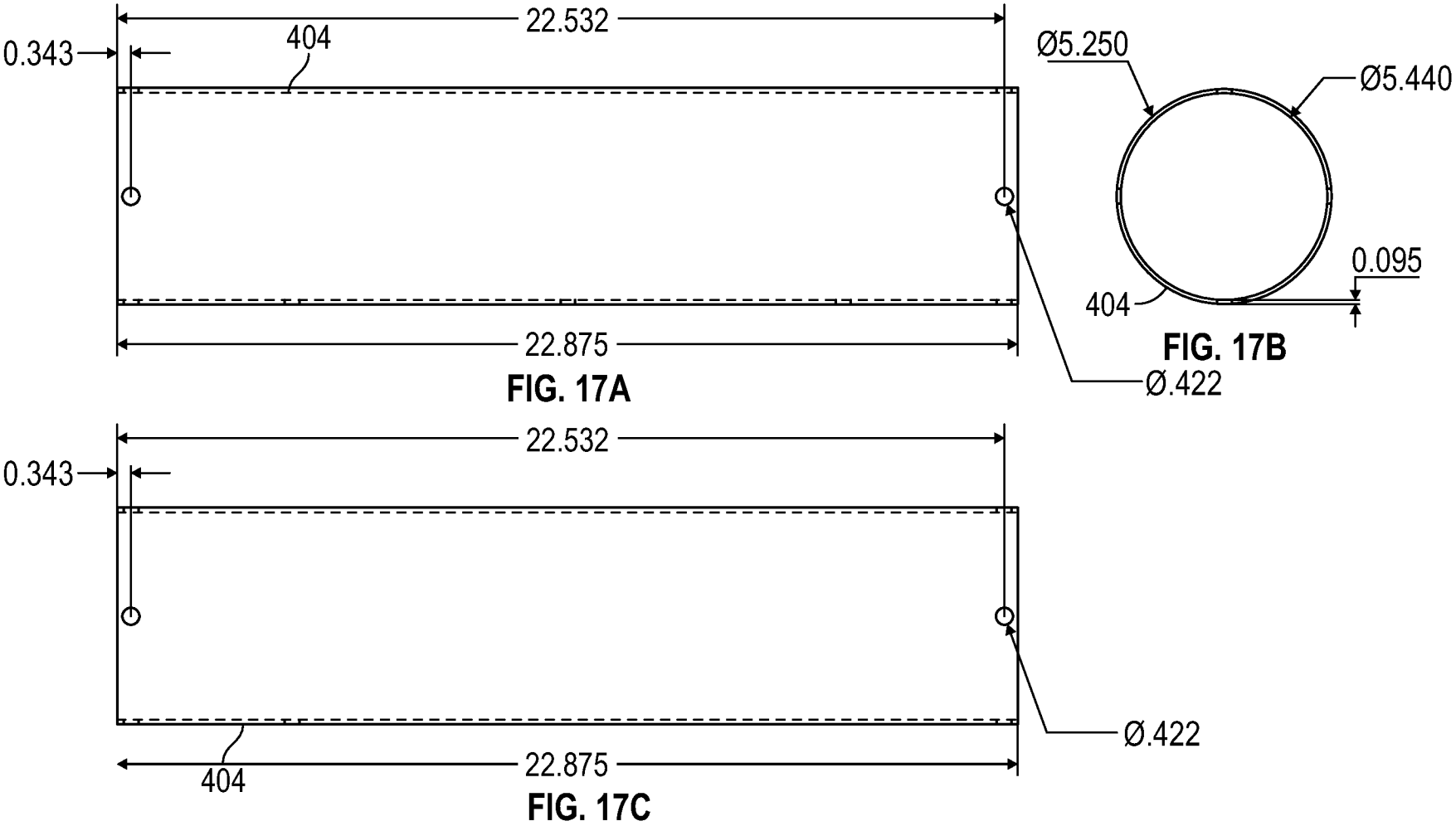
FIGS. 17A-17C illustrate a cup retainer tube according to some embodiments of the present disclosure.

FIGS. 8A-8B illustrate a front cover for a cup dispenser according to some embodiments of the present disclosure. FIGS. 9A-9B illustrate a top/side plate for a cup dispenser according to some embodiments of the present disclosure. FIGS. 10A-10B illustrate a mounting and carrier plate for a cup dispenser according to some embodiments of the present disclosure. FIGS. 11A-11B illustrate a cup plunger for a cup dispenser according to some embodiments of the present disclosure. FIGS. 12A-12C illustrate a rear tube cap according to some embodiments of the present disclosure. FIGS. 13A-13D and 14A-14D illustrate fingers/blocks and compression and/or tension springs according to some embodiments of the present disclosure. FIGS. 15A-15E illustrate a spring retainer bracket according to some embodiments of the present disclosure. FIGS. 16A-16B illustrate a cup plunger return spring according to some embodiments of the present disclosure. FIGS. 17A-17C illustrate a cup retainer tube according to some embodiments of the present disclosure. FIG. 18 illustrates an exploded view of a cup dispenser according to some embodiments of the present disclosure. FIGS. 19A-19D illustrate the mounting and carrier plate housing the tracks for the fingers/blocks according to some embodiments of the present disclosure.

In some embodiments, the assembly sequence is as follows. In step (1), the tube 404 is oriented, such as by placing the tube 404 into a support fixture with a raming handle. In step (2), the tabs 1802A, 1802B, 1802C, 1802D (collectively referred to herein as tabs 1802) are aligned with the mounting plate 494. In step (3), the mounting plate 494 is aligned with the top end of the tube 404.

In step (4), the plunger central cup 496 is aligned with the bottom end of the tube 404. In step (5), the cup plunger return spring 502 is aligned with the plunger. In step (6), the rear tube cap 472 is aligned with the cup plunger return spring 502.

In step (7), the tabs 1802 are aligned to the holes on the tube 404. In step (8), fingers/blocks 482 with compression and/or tension springs 602 and spring brackets 1502 are placed into corresponding tabs 1802. In step (8), the carrier plate 492 is aligned with the mounting plate 494 holding the tabs 1802 in place.

Figure 20:
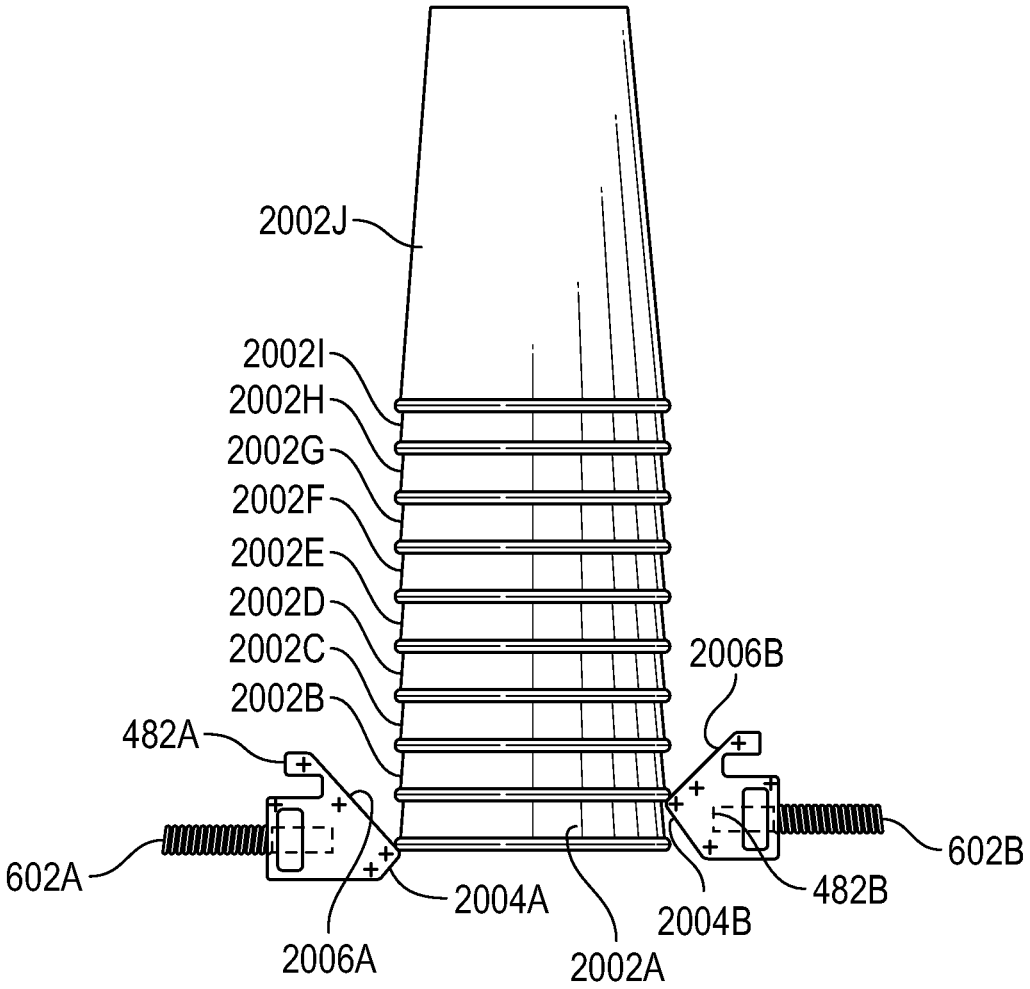
FIG. 20 illustrates fingers holding a stack of cups in a cup dispenser according to some embodiments of the present disclosure.

FIG. 20 illustrates fingers holding a stack of cups in a cup dispenser according to some embodiments of the present disclosure. A first finger 482A can be used to hold the leading cup 2002A in place within the cup dispenser. The first tension spring 602A corresponding to the first finger 482A can exert a pressure toward a surface of the cup. For example, the exerted pressure from the first finger 482A to the cups can be orthogonal to the dispensing direction for the stack of cups. The cup dispenser can include a second finger 482B and a second tension spring 602B that can exert pressure to the second finger 482A which can then in turn exert pressure to one or more trailing cups 2002B, 2002C, 2002D (collectively referred to herein as cups 2002) of a stack of cups. For example, the second finger 482B can exert pressure toward the first trailing cup 2002B of the leading cup 2002A. Accordingly, the fingers can resiliently exert pressure to contain a stack of cups once inserted into the cup dispenser.

In some embodiments, the first finger 482A and the second finger 482A can include active surfaces 2006A, 2006B, respectively, that come into contact with the cups. The active surfaces 2006A, 2006B (active surfaces 2006) can create friction with the surfaces of the cups 2002 to hold the cups within the cup dispenser.

In some embodiments, the fingers 482A, 482B can include passive surfaces 2004A, 2004B (collectively referred to herein as passive surfaces 2004). The passive surfaces 2004 may not come into contact with the cups. In other embodiments, the passive surfaces 2004 may contact the cups. For example, the passive surface 2004B of the second finger 482B can come into contact with the leading cup 2002A, but may be the active surface 2004A of the first finger 482A that is holding the leading cup 2002A in place.

Figure 21:
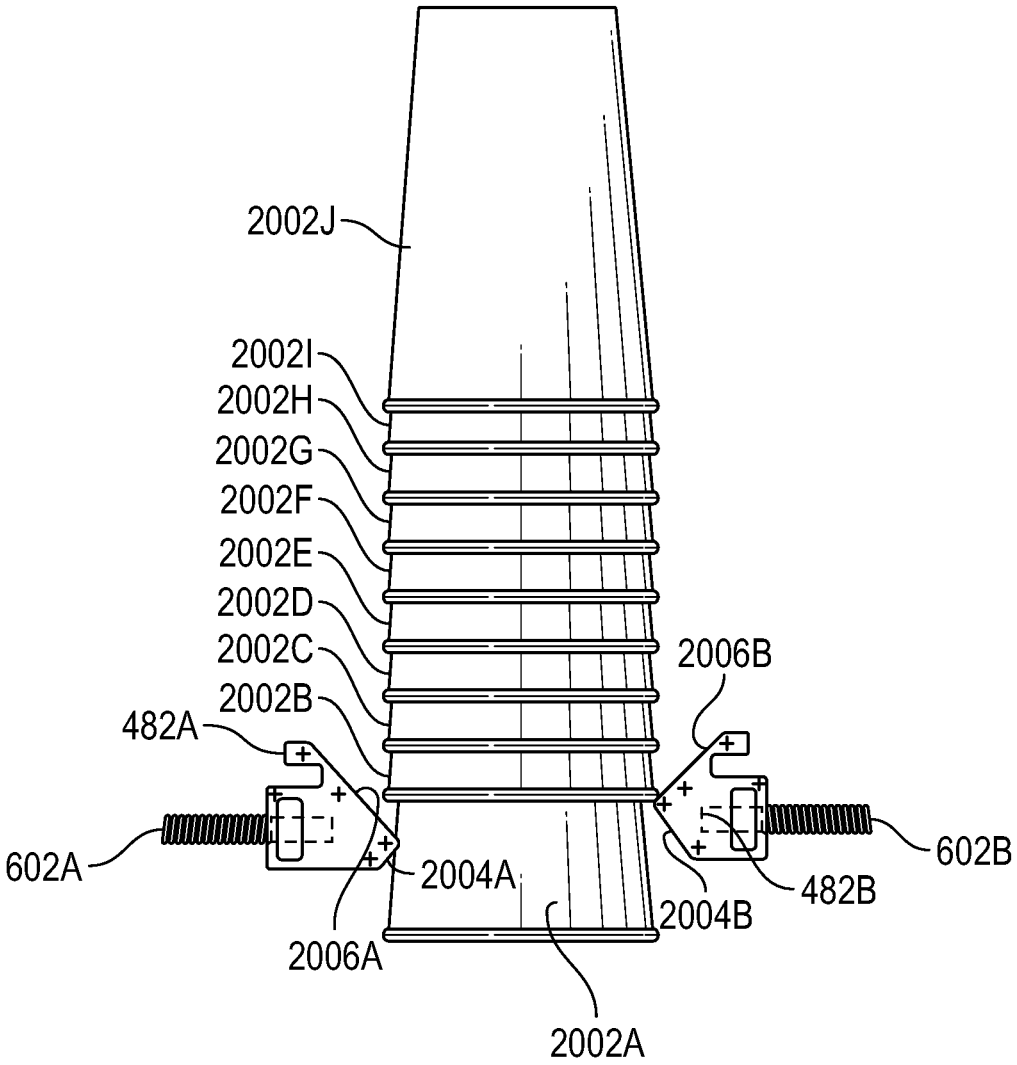
FIG. 21 illustrates dispending of a leading cup in a cup dispenser according to some embodiments of the present disclosure.

FIG. 21 illustrates dispending of a leading cup in a cup dispenser according to some embodiments of the present disclosure. A user of the cup dispenser can pull the leading cup 2002A out of the cup dispenser. The first tension spring 602A can exert a certain amount of pressure on the first finger 482A, and thereafter onto the leading cup 2002A to hold the leading cup 2002A in place. However, the user can pull the leading cup with enough force to push the first finger 482A back, and compress the first tension spring 602A.

In some embodiments, while the leading cup 2002A is being pulled past the first finger, the trailing cup 2002B can be stopped by the second finger 482B based on a pressure exerted by the second tension spring 602B onto the second finger 482B. Advantageously, the leading cup 2002A can be pulled by the user while keeping the trailing cup 2002B contained within the cup dispenser.

Figure 22:
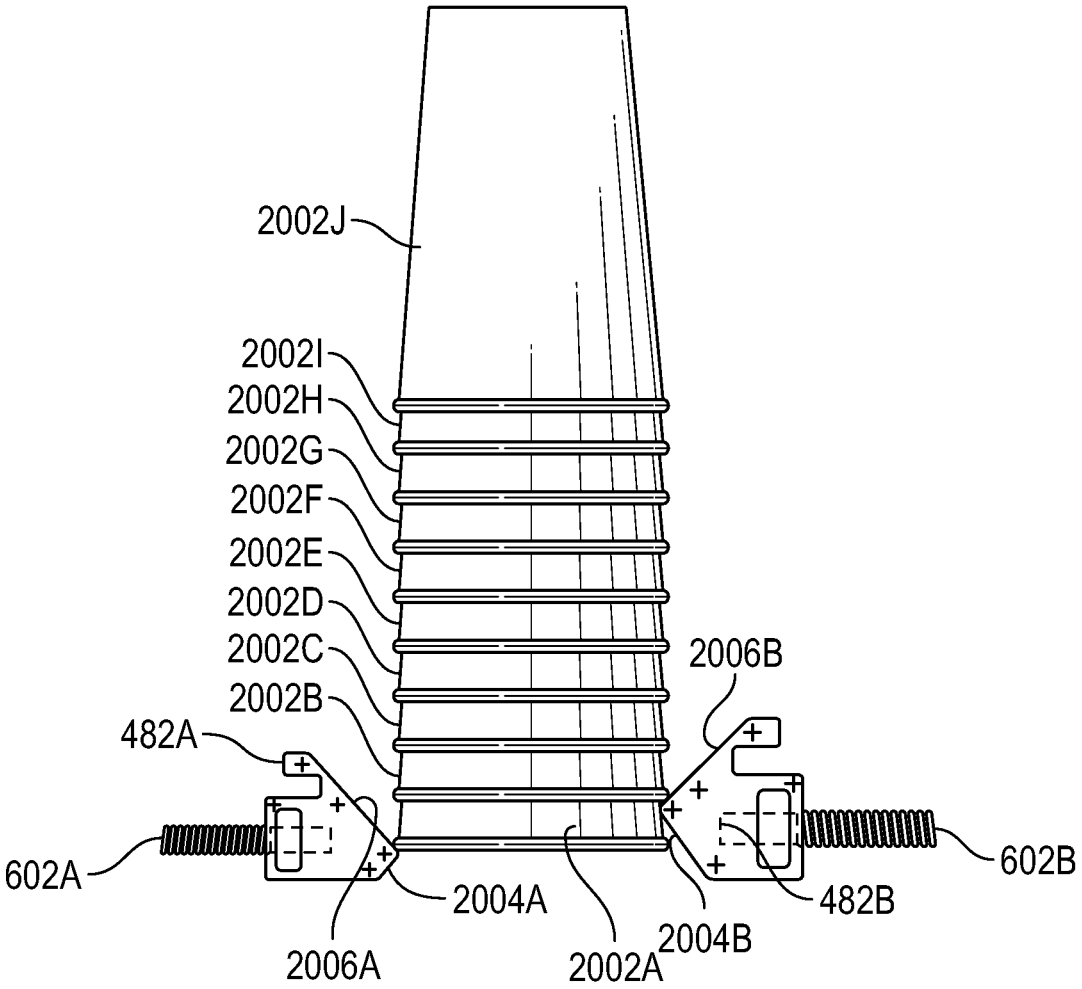
FIG. 22 illustrates variant fingers and tension springs in a cup dispenser according to some embodiments of the present disclosure.

FIG. 22 illustrates variant fingers and tension springs in a cup dispenser according to some embodiments of the present disclosure. In some embodiments, the fingers for a cup dispenser can be different in properties, resulting in different contact points on one or more cups. There can be 1 to N types of fingers on a cup dispenser. For example, a first finger 482A can be of a first size, and a second finger 482B can be of a second size. The first size 482A can be smaller than the second finger 482B. In some embodiments, a first portion of the first finger 482A can be larger than the corresponding portion of the second finger 482B, but a second portion of the first finger 482A can be smaller than the corresponding portion of the second finger 482B.

In some embodiments, finger types can differ by characteristics. A first finger type, such as of a first finger 482A, can include a smaller length, width, and/or height than a second finger type, such as a second finger 482B.

In some embodiments, a first finger type can include a different active and/or passive surface than a second finger type. For example, a first finger 482A can include a first active surface 2006A that is longer or shorter than a second active surface 2006B of a second finger 482A. A first finger 482A can include a first passive surface 2004A that is longer or shorter than a second passive surface 2004B of a second finger 482A. Advantageously, a first finger type can be in contact with the cup longer than a second finger type, and as such, the first finger type creates more friction which holds the cup it is contacting better and/or longer than the cup that is held by the second finger type.

In some embodiments, the finger tips can be different. The finger tip can include an edge, a point, a bend, and/or the like on the surface of the finger. For example, the finger tip can include a bend between an active surface, such as the active surface 2006A, and a passive surface, such as the passive surface 2004A. A first finger type can include a finger tip that is rounder than the finger tip for a second finger type. The first finger type can have a first angle, such as 30 degrees between the active and passive surface, and a second finger type can have a second angle, such as 42 degrees between the active and passive surface. The first finger type can have a round end between the passive and active surface, and a second finger type can have a pointy end between the passive and active surface.

In some embodiments, the finger types can be different based on the material. A first finger type can have an active surface that has a higher friction coefficient than the active surface of a second finger type. For example, a first finger type can be in contact with a leading cup of a sleeve of cups, and a second finger type can be in contact with a trailing cup of a sleeve of cups. The first finger type can include a friction coefficient that is smaller than the second finger type. Thus, the force to dispense the leading cup may be sufficient to pull the cup out of the cup dispenser from the resilient force applied by the fingers of the first finger type, but may not be sufficient to pull a trailing cup from the cup dispenser from the resilient force applied by the fingers of the second finger type.

In some embodiments, one or more finger types can have a plurality of different materials. A first finger type can include a first material for the active surface and a second material for the passive surface. For example, the first material for the active surface can have a higher friction coefficient than the second material on the passive surface, and thus holds the cup better when the cup is in contact with the active surface of the finger.

In some embodiments, the finger types can differ based on positioning within the cup dispenser. A first finger type can be at a smaller depth from the facing entry of the cups than the second finger type. For example, the first finger 482A is closer to the facing entry where the leading cup will be dispensed, and as such, the first finger 482A applies resilient force to the leading cup, whereas the second finger 482B is at a larger depth than the first finger 482B, and as such, the second finger 482B applies resilient force to the trailing cups.

In some embodiments, the finger types can be positioned differently within the cup dispenser. Fingers of a first finger type can be positioned every 30 degrees radially, whereas fingers of a second finger type can be positioned every 45 degrees.

In some embodiments, there can be a different number of fingers for each finger type. There can be 12 fingers of a first finger type, and 8 fingers of a second finger type. Advantageously, the 12 fingers of the first finger type can apply more friction to the corresponding cup than the 8 fingers of the second finger type.

In some embodiments, the tension springs can be of one or more types, such as types 1 to M. Different types of tension springs can exert different resilient forces, factors, pressures, and/or the like. A first tension spring type can exert different resilient factors than a second tension spring type. A first tension spring 602A can have a smaller diameter in coil shape than a second tension spring 602B. A first tension spring 602A can have a smaller thickness of the coil itself than a second tension spring 602B. A first tension spring 602A can have a different tension, compression, strength elastic limit, modulus, fatigue strength, corrosion resistance, magnetic permeability, electrical conductivity, than a second tension spring 602B. A first tension spring 602A can have a different length than a second tension spring 602B.

In some embodiments, a first spring, such as a cup plunger return spring exerts a first pressure onto the cups toward the entry point for the stack of cups or the facing entry of the cups. A second spring can exert a second pressure onto a set of fingers that in turn exert the pressure onto the cups to hold the cups within the cup dispenser. In some embodiments, the first spring is orthogonal and/or non-parallel to the second spring. In some embodiments, the first pressure exerted by the first spring is orthogonal and/or non-parallel to the second pressure exerted by the second spring.

Many variations and modifications may be made to the above-described embodiments, the elements of which are to be understood as being among other acceptable examples. All such modifications and variations are intended to be included herein within the scope of this disclosure. The foregoing description details certain embodiments. It will be appreciated, however, that no matter how detailed the foregoing appears in text, the systems and methods can be practiced in many ways. As is also stated above, it should be noted that the use of particular terminology when describing certain features or aspects of the systems and methods should not be taken to imply that the terminology is being re-defined herein to be restricted to including any specific characteristics of the features or aspects of the systems and methods with which that terminology is associated.

Conditional language, such as, among others, "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements and/or steps are in any way required for one or more embodiments or that one or more embodiments necessarily include logic for deciding, with or without user input or prompting, whether these features, elements and/or steps are included or are to be performed in any particular embodiment.

The term "substantially" when used in conjunction with the term "real-time" forms a phrase that will be readily understood by a person of ordinary skill in the art. For example, it is readily understood that such language will include speeds in which no or little delay or waiting is discernible, or where such delay is sufficiently short so as not to be disruptive, irritating, or otherwise vexing to a user.

Conjunctive language such as the phrase "at least one of X, Y, and Z," or "at least one of X, Y, or Z," unless specifically stated otherwise, is to be understood with the context as used in general to convey that an item, term, etc. may be either X, Y, or Z, or a combination thereof. For example, the term "or" is used in its inclusive sense (and not in its exclusive sense) so that when used, for example, to connect a list of elements, the term "or" means one, some, or all of the elements in the list. Thus, such conjunctive language is not generally intended to imply that certain embodiments require at least one of X, at least one of Y, and at least one of Z to each be present.

The term "a" as used herein should be given an inclusive rather than exclusive interpretation. For example, unless specifically noted, the term "a" should not be understood to mean "exactly one" or "one and only one"; instead, the term "a" means "one or more" or "at least one," whether used in the claims or elsewhere in the specification and regardless of uses of quantifiers such as "at least one," "one or more," or "a plurality" elsewhere in the claims or specification.

The term "comprising" as used herein should be given an inclusive rather than exclusive interpretation. For example, a general purpose computer comprising one or more processors should not be interpreted as excluding other computer components, and may possibly include such components as memory, input/output devices, and/or network interfaces, among others.

While the above detailed description has shown, described, and pointed out novel features as applied to various embodiments, it may be understood that various omissions, substitutions, and changes in the form and details of the devices or processes illustrated may be made without departing from the spirit of the disclosure. As may be recognized, certain embodiments of the inventions described herein may be embodied within a form that does not provide all of the features and benefits set forth herein, as some features may be used or practiced separately from others. The scope of certain inventions disclosed herein is indicated by the appended claims rather than by the foregoing description. All changes which come within the meaning and range of equivalency of the claims are to be embraced within their scope.

The invention claimed is:

1. A cup dispenser configured to automatically accommodate for varying cup characteristics, the cup dispenser comprising:

a front cover configured to receive a sleeve of cups inserted into the cup dispenser;

a mounting plate, wherein the front cover is attached to the mounting plate;

a plurality of blocks, each block configured to apply pressure to a contact point on at least a cup of the sleeve of cups;

a first spring configured to resiliently apply a first pressure applied by a first subset of the plurality of blocks to a first contact point of a first contact point type on the cup;

a cup retainer tube configured to contain the sleeve of cups;

a rear tube cap configured to stop the sleeve of cups that is inserted into the cup dispenser;

a cup plunger;

a second spring configured to apply pressure to the cup plunger in order to push the cups to the front cover for dispensing of the cups, and a third spring configured to apply a second pressure applied by a second subset of the plurality of blocks to a second contact point of a second contact point type on the cup.

2. A cup dispensing system configured to automatically accommodate for varying cup characteristics, the cup dispenser comprising:

a front cover configured to receive a stack of cups inserted into the cup dispenser;

a mounting plate, wherein the front cover is attached to the mounting plate;

a plurality of fingers, each finger configured to apply pressure to a contact point on at least a cup of the stack of cups;

a first spring configured to resiliently apply a first pressure applied by a first subset of the plurality of fingers to a first contact point of a first contact point type on the cup;

a cup retainer tube configured to contain the stack of cups;

a rear tube cap configured to stop the stack of cups that is inserted into the cup dispenser;

a cup plunger; and a second spring configured to apply pressure to the cup plunger in order to push the cups to the front cover for dispensing of the cups, wherein the first spring is orthogonal with the second spring.

3. The cup dispensing system of claim 2, wherein the mounting plate comprises a circumferential carrier plate that, together with the circumferential mounting plate, house sliding tracks for the plurality of fingers.

4. The cup dispensing system of claim 2, wherein the plurality of fingers comprises at least a first and second type of fingers, the first type having a different shape and angles than the second type, wherein the first type interacts differently with the stack of cups than the second type.

5. The cup dispensing system of claim 2, wherein the plurality of fingers include a first and second type, wherein the first type is configured to allow dispending of a leading cup of the stack of cups, wherein the second type is configured to apply pressure to one or more trailing cup of the stack of cups while the first cup is being dispensed, wherein the pressure to the one or more trailing cups are configured to retain the one or more trailing cups while the leading cup is being dispensed.

6. The cup dispensing system of claim 2, wherein the plurality of fingers include a first and second type, wherein the plurality of fingers corresponding to the first type is disposed at a first depth from the facing entry for the cups where the cups are inserted into the cup dispensing system, and the plurality of fingers corresponding to the second type is disposed at a second depth from the facing entry for the cups.

7. The cup dispensing system of claim 2, wherein the plurality of fingers include a first and second type, wherein the plurality of fingers corresponding to the first type and the plurality of fingers corresponding to the second type are staggered such that the point of contact to the cup for the plurality of fingers corresponding to the first type is different than the point of contact to the cup for the plurality of fingers corresponding to the first type.

8. The cup dispensing system of claim 2, wherein the plurality of fingers include a first and second type, wherein the plurality of fingers corresponding to the first type is configured for a first type of cup, and the plurality of fingers corresponding to the second type is configured for a second type of cup.

9. The cup dispensing system of claim 2, wherein the plurality of fingers include a first and second type, wherein the plurality of fingers corresponding to the first type comprises a longer taper, and the plurality of fingers corresponding to the second type comprises a shorter taper.

10. The cup dispensing system of claim 2, wherein each finger comprises a plurality of angled faces, wherein a first angled face of the plurality of angled faces is configured to accommodate cup loading, and a second angled face of the plurality of angled faces is configured to accommodate cup dispensing.

11. The cup dispensing system of claim 10, wherein each angled face interacts mechanically with the first spring located behind the corresponding finger to facilitate loading and dispensing.

12. The cup dispensing system of claim 2, wherein the first spring extends radially from an elongate axis of the tube, and exerts a force against the finger toward a central axis of the tube when compressed outwardly.

13. The cup dispensing system of claim 12, wherein the first spring is held in place with at least one protruding tab that is rigidly associated with the mounting plate.

14. A cup dispenser configured to automatically accommodate for varying cup characteristics, the cup dispenser comprising:

a front cover configured to receive a sleeve of cups inserted into the cup dispenser;

a mounting plate, wherein the front cover is attached to the mounting plate;

a plurality of blocks, each block configured to apply pressure to a contact point on at least a cup of the sleeve of cups;

a first spring configured to resiliently apply a first pressure applied by a first subset of the plurality of blocks to a first contact point of a first contact point type on the cup;

a cup retainer tube configured to contain the sleeve of cups;

a rear tube cap configured to stop the sleeve of cups that is inserted into the cup dispenser;

a cup plunger; and a second spring configured to apply pressure to the cup plunger in order to push the cups to the front cover for dispensing of the cups, wherein the first spring is non-parallel with the second spring.

15. The cup dispenser of claim 14, wherein the first spring is orthogonal with the second spring.

16. The cup dispenser of claim 14, wherein the pressure exerted by the first spring is orthogonal to the pressure exerted by the second spring.

17. The cup dispenser of claim 14, further comprising a third spring configured to apply a second pressure applied by a second subset of the plurality of blocks to a second contact point of a second contact point type on the cup.

18. The cup dispenser of claim 17, wherein the first pressure and second pressure are different.

19. The cup dispenser of claim 17, wherein the first spring has a different thickness than the second spring.

20. The cup dispenser of claim 17, wherein the first spring has a different length of the second spring.

* * * * *